US008590743B2

(12) United States Patent
Beland et al.

(10) Patent No.: US 8,590,743 B2
(45) Date of Patent: Nov. 26, 2013

(54) ACTUATOR CAP FOR A SPRAY DEVICE

(75) Inventors: Rene Maurice Beland, Waterford, WI (US); Thomas A. Helf, New Berlin, WI (US); James F. Kimball, Greenfield, WI (US); Edward L. Paas, Los Altos, CA (US)

(73) Assignee: S.C. Johnson & Son, Inc., Racine, WI (US)

( * ) Notice: Subject to any disclaimer, the term of this patent is extended or adjusted under 35 U.S.C. 154(b) by 1637 days.

(21) Appl. No.: 11/801,554

(22) Filed: May 10, 2007

(65) Prior Publication Data

US 2008/0277411 A1 Nov. 13, 2008

(51) Int. Cl.
*B67D 7/14* (2010.01)

(52) U.S. Cl.
USPC ..... 222/52; 222/402.13; 222/1; 222/649; 222/63; 222/504; 222/402.21

(58) Field of Classification Search
USPC ..... 222/402.13, 504, 402.21–402.23, 180, 222/402.1, 649, 52, 61, 63, 1, 646; 251/129.2
See application file for complete search history.

(56) References Cited

U.S. PATENT DOCUMENTS 1,767,738 A * 6/1930 Brown ..... 84/338
2,608,319 A 8/1952 Petry
2,613,108 A 10/1952 Kraus
2,928,573 A 3/1960 Edelstein
3,018,056 A 1/1962 Montgomery
3,079,048 A * 2/1963 Wolfson et al. ..... 222/108
3,115,277 A 12/1963 Montague, Jr.
3,127,060 A 3/1964 Vosbikian et al.
3,165,238 A 1/1965 Wiley
3,180,532 A 4/1965 Michel
3,185,356 A 5/1965 Venus, Jr.
3,199,732 A 8/1965 Strachan
3,228,609 A 1/1966 Edelstein et al.
3,240,389 A 3/1966 Genua
3,269,602 A 8/1966 Weber, III
3,273,610 A 9/1966 Frost
3,289,886 A 12/1966 Goldsholl et al.
3,305,134 A 2/1967 Carmichael et al.

(Continued)

FOREIGN PATENT DOCUMENTS

EP 656230 6/1995
EP 0676133 10/1995

(Continued)

OTHER PUBLICATIONS

PCT/US2008/005889 International Search Report and Written Opinion dated Dec. 10, 2009.

(Continued)

*Primary Examiner* — Paul R Durand
*Assistant Examiner* — Robert Nichols, II

(57) ABSTRACT

An overcap for a dispenser includes a housing mountable on a container. The container includes a tilt-activated valve stem with a discharge end. The discharge end of the valve stem is adapted to be in fluid communication with a discharge orifice of the housing. A drive unit is disposed within the housing, wherein the drive unit includes a solenoid, a bi-metallic actuator, a piezo-linear motor, or an electro-responsive wire, which is adapted to impart transverse motion to the valve stem to open a valve of the container.

19 Claims, 27 Drawing Sheets

(56) References Cited

U.S. PATENT DOCUMENTS 3,326,418 A 6/1967 Kropp
3,329,314 A 7/1967 Kolodziej
3,357,604 A * 12/1967 Barker ..... 222/402.23
3,368,717 A 2/1968 Weber, III
3,398,864 A 8/1968 Kolodziej
3,411,670 A 11/1968 Mangel
3,419,189 A 12/1968 Iketani
3,420,445 A * 1/1969 Inzerill ..... 239/274
3,434,633 A * 3/1969 Green ..... 222/402.13
3,455,485 A 7/1969 Crownover
3,477,613 A 11/1969 Mangel
3,497,108 A 2/1970 Mason
3,497,110 A 2/1970 Bombero et al.
3,506,165 A * 4/1970 Beard ..... 222/402.22
3,542,248 A 11/1970 Mangel
3,543,122 A 11/1970 Klebanoff et al.
3,584,766 A 6/1971 Hart et al.
3,589,562 A 6/1971 Buck
3,589,563 A 6/1971 Carragan et al.
3,591,058 A 7/1971 Johnston
3,617,214 A 11/1971 Dolac
3,620,023 A 11/1971 Schmid
3,627,176 A 12/1971 Sailors
3,632,020 A 1/1972 Nixon, Jr. et al.
3,635,379 A * 1/1972 Angele ..... 222/402.22
3,643,836 A 2/1972 Hunt
3,658,209 A 4/1972 Freeman et al.
3,664,548 A 5/1972 Broderick
3,666,144 A 5/1972 Winder
3,677,441 A 7/1972 Nixon, Jr. et al.
3,690,519 A 9/1972 Wassilieff
3,700,144 A * 10/1972 Smrt ..... 222/609
3,722,749 A 3/1973 Ishida
3,726,437 A 4/1973 Siegel
3,732,509 A 5/1973 Florant et al.
3,739,944 A 6/1973 Rogerson
3,756,465 A 9/1973 Meshberg
3,759,427 A * 9/1973 Stanley et al. ..... 222/402.23
3,794,216 A 2/1974 Buck
3,817,429 A 6/1974 Smrt
3,821,927 A * 7/1974 Stratman et al. ..... 100/73
3,870,274 A 3/1975 Broe
3,871,557 A 3/1975 Smrt
3,885,712 A 5/1975 Libit
3,929,259 A 12/1975 Fegley et al.
3,952,916 A 4/1976 Phillips
3,968,905 A 7/1976 Pelton
3,974,941 A 8/1976 Mettler
3,980,205 A 9/1976 Smart
4,004,550 A 1/1977 White et al.
4,006,844 A 2/1977 Corris
4,044,652 A * 8/1977 Lewis et al. ..... 91/368
4,063,664 A 12/1977 Meetze, Jr.
4,064,573 A 12/1977 Calderone
4,068,575 A 1/1978 Difley et al.
4,068,780 A 1/1978 Fegley
4,077,542 A 3/1978 Petterson
4,096,974 A 6/1978 Haber et al.
4,184,612 A 1/1980 Freyre
4,235,373 A 11/1980 Clark
4,238,055 A 12/1980 Staar
4,275,821 A 6/1981 Lanno et al.
4,396,152 A 8/1983 Abplanalp
4,415,797 A 11/1983 Choustoulakis
4,483,466 A 11/1984 Gutierrez
4,544,086 A 10/1985 Hill et al.
4,625,342 A * 12/1986 Gangnath et al. ..... 4/228.1
4,658,985 A 4/1987 Madsen et al.
4,840,193 A * 6/1989 Schiel ..... 137/627.5
4,877,989 A 10/1989 Drews et al.
4,967,935 A 11/1990 Celest
4,989,755 A 2/1991 Shiau
4,993,570 A 2/1991 Julian et al.
5,012,961 A 5/1991 Madsen et al.
5,014,881 A 5/1991 Andris
5,018,963 A 5/1991 Diederich
5,025,962 A 6/1991 Renfro
5,029,729 A 7/1991 Madsen et al.
5,038,972 A 8/1991 Muderlak et al.
5,055,822 A 10/1991 Campbell et al.
5,098,291 A 3/1992 Curtis et al.
5,134,961 A 8/1992 Giles et al.
5,154,323 A 10/1992 Query et al.
5,198,157 A 3/1993 Bechet
5,221,025 A 6/1993 Privas
5,249,718 A 10/1993 Muderlak
5,263,616 A * 11/1993 Abplanalp ..... 222/402.13
5,297,988 A 3/1994 Nishino et al.
5,337,926 A 8/1994 Drobish et al.
5,337,929 A 8/1994 van der Heijden
5,342,584 A 8/1994 Fritz et al.
5,353,744 A 10/1994 Custer
5,364,028 A 11/1994 Wozniak
5,383,580 A 1/1995 Winder
RE34,847 E * 2/1995 Muderlak et al. ..... 222/25
5,392,768 A 2/1995 Johansson et al.
5,397,028 A 3/1995 Jesadanont
5,445,324 A 8/1995 Berry et al.
5,447,273 A 9/1995 Wozniak
5,447,277 A 9/1995 Schlüter et al.
5,449,117 A 9/1995 Muderlak et al.
5,489,047 A 2/1996 Winder
5,503,303 A 4/1996 LaWare et al.
5,522,722 A 6/1996 Diederich
5,531,344 A 7/1996 Winner
5,540,359 A 7/1996 Gobbel
5,542,605 A 8/1996 Campau
5,549,228 A 8/1996 Brown
5,560,146 A * 10/1996 Garro ..... 43/74
5,588,565 A 12/1996 Miller
5,601,235 A 2/1997 Booker et al.
5,622,162 A 4/1997 Johansson et al.
5,673,825 A 10/1997 Chen
5,676,283 A 10/1997 Wang
5,685,456 A 11/1997 Goldstein
5,695,091 A 12/1997 Winings et al.
5,702,036 A 12/1997 Ferrara, Jr.
5,743,251 A 4/1998 Howell et al.
5,772,074 A 6/1998 Dial et al.
5,787,947 A 8/1998 Hertsgaard
5,791,524 A 8/1998 Demarest
5,810,265 A 9/1998 Cornelius et al.
5,823,390 A 10/1998 Muderlak et al.
5,842,602 A 12/1998 Pierpoint
5,853,129 A 12/1998 Spitz
5,884,808 A 3/1999 Muderlak et al.
5,908,140 A 6/1999 Muderlak et al.
5,922,247 A 7/1999 Shoham et al.
5,924,597 A 7/1999 Lynn
5,938,076 A 8/1999 Ganzeboom
5,957,342 A * 9/1999 Gallien ..... 222/402.22
5,964,403 A 10/1999 Miller et al.
6,000,658 A 12/1999 McCall, Jr.
6,006,957 A 12/1999 Kunesh
6,036,108 A 3/2000 Chen
6,039,212 A 3/2000 Singh
6,089,410 A 7/2000 Ponton
6,145,712 A 11/2000 Benoist
6,182,904 B1 2/2001 Ulczynski et al.
6,216,925 B1 4/2001 Garon
6,220,293 B1 4/2001 Rashidi
6,237,812 B1 5/2001 Fukada
6,249,717 B1 6/2001 Nicholson et al.
6,254,065 B1 7/2001 Ehrensperger et al.
6,260,739 B1 7/2001 Hsiao
6,267,297 B1 7/2001 Contadini et al.
6,276,574 B1 8/2001 Smrt
6,293,442 B1 9/2001 Mollayan
6,293,474 B1 9/2001 Helf et al.
6,321,742 B1 11/2001 Schmidt et al.
6,338,424 B2 1/2002 Nakamura et al.
6,343,714 B1 2/2002 Tichenor
6,364,283 B1 * 4/2002 Sieber ..... 251/129.2
6,394,310 B1 5/2002 Muderlak et al.

(56) References Cited

U.S. PATENT DOCUMENTS

| | | | | |
|---|---|---|---|---|
| 6,409,093 | B2 | 6/2002 | Ulczynski et al. | |
| 6,419,122 | B1 | 7/2002 | Chown | |
| 6,454,185 | B2 | 9/2002 | Fuchs | |
| 6,478,199 | B1 | 11/2002 | Shanklin et al. | |
| 6,510,561 | B1 | 1/2003 | Hammond et al. | |
| 6,517,009 | B2 | 2/2003 | Yahav | |
| 6,533,141 | B1 | 3/2003 | Petterson et al. | |
| 6,540,155 | B1 | 4/2003 | Yahav | |
| 6,554,203 | B2 | 4/2003 | Hess et al. | |
| 6,567,613 | B2 | 5/2003 | Rymer | |
| 6,588,627 | B2 | 7/2003 | Petterson et al. | |
| 6,612,464 | B2 | 9/2003 | Petterson et al. | |
| 6,616,363 | B1 | 9/2003 | Guillaume et al. | |
| 6,619,562 | B2 | 9/2003 | Hamaguchi et al. | |
| 6,644,507 | B2 | 11/2003 | Borut et al. | |
| 6,645,307 | B2 | 11/2003 | Fox et al. | |
| 6,669,105 | B2 | 12/2003 | Bryan et al. | |
| 6,688,492 | B2 | 2/2004 | Jaworski et al. | |
| 6,694,536 | B1 | 2/2004 | Haygreen | |
| 6,701,663 | B1 | 3/2004 | Hughel et al. | |
| 6,708,849 | B1 | 3/2004 | Carter et al. | |
| D488,548 | S | 4/2004 | Lablaine | |
| 6,722,529 | B2 | 4/2004 | Ceppaluni et al. | |
| 6,739,479 | B2 | 5/2004 | Contadini et al. | |
| 6,769,580 | B2 | 8/2004 | Muderlak et al. | |
| 6,776,968 | B2 | 8/2004 | Edwards et al. | |
| 6,785,911 | B1 | 9/2004 | Percher | |
| 6,790,408 | B2 | 9/2004 | Whitby et al. | |
| 6,832,701 | B2 | 12/2004 | Schiller | |
| 6,837,396 | B2 | 1/2005 | Jaworski et al. | |
| 6,843,465 | B1 | 1/2005 | Scott | |
| 6,877,636 | B2 | 4/2005 | Speckhart et al. | |
| 6,918,512 | B2 | 7/2005 | Kondoh | |
| 6,926,002 | B2 | 8/2005 | Scarrott et al. | |
| 6,926,172 | B2 | 8/2005 | Jaworski et al. | |
| 6,926,211 | B2 | 8/2005 | Bryan et al. | |
| 6,938,796 | B2 | 9/2005 | Blacker et al. | |
| 6,971,560 | B1 | 12/2005 | Healy et al. | |
| 6,974,091 | B2 | 12/2005 | McLisky | |
| 6,978,947 | B2 | 12/2005 | Jin | |
| D513,433 | S | 1/2006 | Lemaire | |
| 6,997,349 | B2 | 2/2006 | Blacker et al. | |
| 7,000,853 | B2 | 2/2006 | Fugere | |
| 7,028,917 | B2 | 4/2006 | Buthier | |
| 7,032,782 | B1 | 4/2006 | Ciavarella et al. | |
| D520,623 | S | 5/2006 | Lablaine | |
| 7,044,337 | B1 | 5/2006 | Kou | |
| 7,051,455 | B2 | 5/2006 | Bedford | |
| D525,693 | S | 7/2006 | Butler et al. | |
| D527,472 | S | 8/2006 | Barraclough et al. | |
| D532,891 | S | 11/2006 | Buthier et al. | |
| 7,141,125 | B2 | 11/2006 | McKechnie et al. | |
| D536,059 | S | 1/2007 | King et al. | |
| D536,082 | S | 1/2007 | Pugh | |
| 7,168,631 | B2 | 1/2007 | Jones | |
| 7,182,227 | B2 | 2/2007 | Poile et al. | |
| D537,914 | S | 3/2007 | King et al. | |
| D538,915 | S | 3/2007 | Anderson et al. | |
| 7,192,610 | B2 | 3/2007 | Hughes et al. | |
| 7,195,139 | B2 | 3/2007 | Jaworski et al. | |
| D540,931 | S | 4/2007 | Luo | |
| 7,222,760 | B1 * | 5/2007 | Tsay | 222/642 |
| 7,223,361 | B2 | 5/2007 | Kvietok et al. | |
| 7,226,034 | B2 * | 6/2007 | Stark et al. | 251/76 |
| 7,249,720 | B2 | 7/2007 | Mathiez | |
| 8,361,543 | B2 * | 1/2013 | Nielsen et al. | 427/137 |
| 2002/0020756 | A1 | 2/2002 | Yahav | |
| 2003/0089734 | A1 | 5/2003 | Eberhardt et al. | |
| 2003/0132254 | A1 | 7/2003 | Giangreco | |
| 2004/0011885 | A1 | 1/2004 | McLisky | |
| 2004/0028551 | A1 | 2/2004 | Kvietok et al. | |
| 2004/0033171 | A1 | 2/2004 | Kvietok et al. | |
| 2004/0035949 | A1 | 2/2004 | Elkins et al. | |
| 2004/0074935 | A1 | 4/2004 | Chon | |
| 2004/0155056 | A1 | 8/2004 | Yahav | |
| 2004/0219863 | A1 | 11/2004 | Willacy | |
| 2005/0004714 | A1 | 1/2005 | Chen | |
| 2005/0023287 | A1 | 2/2005 | Speckhart et al. | |
| 2005/0139624 | A1 | 6/2005 | Hooks et al. | |
| 2005/0155985 | A1 | 7/2005 | Meyer | |
| 2005/0201944 | A1 | 9/2005 | Kvietok et al. | |
| 2005/0224596 | A1 | 10/2005 | Panopoulos | |
| 2005/0252930 | A1 | 11/2005 | Contadini et al. | |
| 2005/0279853 | A1 | 12/2005 | McLeisch et al. | |
| 2006/0011737 | A1 | 1/2006 | Amenos et al. | |
| 2006/0037532 | A1 | 2/2006 | Eidson | |
| 2006/0060615 | A1 | 3/2006 | McLisky | |
| 2006/0076366 | A1 | 4/2006 | Furner et al. | |
| 2006/0081661 | A1 | 4/2006 | Lasserre et al. | |
| 2006/0083632 | A1 | 4/2006 | Hammond et al. | |
| 2006/0118658 | A1 | 6/2006 | Corkhill et al. | |
| 2006/0124477 | A1 | 6/2006 | Cornelius et al. | |
| 2006/0140901 | A1 | 6/2006 | McKechnie | |
| 2006/0151546 | A1 | 7/2006 | McLisky | |
| 2006/0153733 | A1 | 7/2006 | Sassoon | |
| 2006/0175341 | A1 | 8/2006 | Rodrian | |
| 2006/0175357 | A1 | 8/2006 | Hammond | |
| 2006/0175426 | A1 | 8/2006 | Schramm et al. | |
| 2006/0191955 | A1 | 8/2006 | McLisky | |
| 2006/0196576 | A1 | 9/2006 | Fleming et al. | |
| 2006/0210421 | A1 | 9/2006 | Hammond et al. | |
| 2006/0219740 | A1 | 10/2006 | Bayer | |
| 2006/0229232 | A1 | 10/2006 | Contadini et al. | |
| 2006/0243762 | A1 | 11/2006 | Sassoon | |
| 2007/0012718 | A1 | 1/2007 | Schramm et al. | |
| 2007/0062980 | A1 | 3/2007 | Bates et al. | |
| 2007/0071933 | A1 | 3/2007 | Gavelli et al. | |
| 2007/0087953 | A1 | 4/2007 | McKechnie et al. | |
| 2007/0093558 | A1 | 4/2007 | Harper et al. | |
| 2007/0138326 | A1 | 6/2007 | Hu | |
| 2007/0158359 | A1 | 7/2007 | Rodrian | |

FOREIGN PATENT DOCUMENTS

| | | |
|---|---|---|
| EP | 0826607 | 3/1998 |
| EP | 0826608 | 3/1998 |
| EP | 1184083 | 3/2002 |
| EP | 1214949 | 6/2002 |
| EP | 1316514 | 6/2003 |
| EP | 1382399 | 1/2004 |
| EP | 1430958 | 6/2004 |
| EP | 1522506 | 4/2005 |
| EP | 1328757 | 5/2006 |
| EP | 1695720 | 8/2006 |
| EP | 1702512 | 9/2006 |
| EP | 1702513 | 9/2006 |
| EP | 1709980 | 10/2006 |
| EP | 1726315 | 11/2006 |
| FR | 1497250 | 10/1967 |
| FR | 2216810 | 8/1974 |
| GB | 1033025 | 6/1966 |
| JP | 56037070 | 4/1981 |
| JP | 56044060 | 4/1981 |
| JP | 56044061 | 4/1981 |
| JP | 56044062 | 4/1981 |
| JP | 56070865 | 6/1981 |
| JP | 57174173 | 10/1982 |
| JP | 61232177 | 10/1986 |
| JP | 62109760 | 7/1987 |
| JP | 01-223904 | 9/1989 |
| JP | 03-085169 | 4/1991 |
| JP | 03-085170 | 4/1991 |
| JP | 10216577 | 8/1998 |
| JP | 2001048254 | 2/2001 |
| JP | 2002068344 | 3/2002 |
| JP | 2002113398 | 4/2002 |
| JP | 2003246380 | 9/2003 |
| JP | 2003311191 | 11/2003 |
| JP | 2004298782 | 10/2004 |
| JP | 2005081223 | 3/2005 |
| WO | WO 91/15409 | 10/1991 |
| WO | WO 95/19304 | 7/1995 |
| WO | WO95/29106 | 11/1995 |
| WO | WO 99/34266 | 7/1999 |

(56) References Cited

FOREIGN PATENT DOCUMENTS

| | | |
|---|---|---|
| WO | WO 00/47335 | 8/2000 |
| WO | WO 00/64802 | 11/2000 |
| WO | WO 00/75046 | 12/2000 |
| WO | WO00/75046 | 12/2000 |
| WO | WO 00/78467 | 12/2000 |
| WO | WO 01/26448 | 4/2001 |
| WO | WO 02/40177 | 5/2002 |
| WO | WO 02/40376 | 5/2002 |
| WO | WO 02/072161 | 9/2002 |
| WO | WO 02/079679 | 10/2002 |
| WO | WO 02/087976 | 11/2002 |
| WO | WO 02/094014 | 11/2002 |
| WO | WO03/037748 | 5/2003 |
| WO | WO 03/037748 | 5/2003 |
| WO | WO03/037750 | 5/2003 |
| WO | WO 03/037750 | 5/2003 |
| WO | WO03/042068 | 5/2003 |
| WO | WO 03/042068 | 5/2003 |
| WO | WO03/062094 | 7/2003 |
| WO | WO 03/062094 | 7/2003 |
| WO | WO 03/062095 | 7/2003 |
| WO | WO03/062095 | 7/2003 |
| WO | WO 03/068412 | 8/2003 |
| WO | WO 03/068413 | 8/2003 |
| WO | WO03/082709 | 10/2003 |
| WO | WO 03/086902 | 10/2003 |
| WO | WO 03/086947 | 10/2003 |
| WO | WO 03/099682 | 12/2003 |
| WO | WO 03/104109 | 12/2003 |
| WO | WO 2004/043502 | 5/2004 |
| WO | WO 2004/067963 | 8/2004 |
| WO | WO 2004/073875 | 9/2004 |
| WO | WO 2004/093927 | 11/2004 |
| WO | WO 2004/093928 | 11/2004 |
| WO | WO2005/011560 | 2/2005 |
| WO | WO2005/014060 | 2/2005 |
| WO | WO 2005/018691 | 3/2005 |
| WO | WO 2005/023679 | 3/2005 |
| WO | WO2005/027630 | 3/2005 |
| WO | WO2005/048718 | 6/2005 |
| WO | WO2005/070474 | 8/2005 |
| WO | WO 2005/072059 | 8/2005 |
| WO | WO 2005/072522 | 8/2005 |
| WO | WO2005/079583 | 9/2005 |
| WO | WO2005/084721 | 9/2005 |
| WO | WO2006/005962 | 1/2006 |
| WO | WO 2006/012248 | 2/2006 |
| WO | WO2006/013321 | 2/2006 |
| WO | WO2006/013322 | 2/2006 |
| WO | WO 2006/044416 | 4/2006 |
| WO | WO2006/051267 | 5/2006 |
| WO | WO2006/054103 | 5/2006 |
| WO | WO2006/056762 | 6/2006 |
| WO | WO2006/058433 | 6/2006 |
| WO | WO2006/064187 | 6/2006 |
| WO | WO 2006/074454 | 7/2006 |
| WO | WO2006/087514 | 8/2006 |
| WO | WO2006/087515 | 8/2006 |
| WO | WO2006/095131 | 9/2006 |
| WO | WO 2006/104993 | 10/2006 |
| WO | WO 2006/105652 | 10/2006 |
| WO | WO 2006/108043 | 10/2006 |
| WO | WO2006/134353 | 12/2006 |
| WO | WO2007/028954 | 3/2007 |
| WO | WO 2007/029044 | 3/2007 |
| WO | WO2007/036724 | 4/2007 |
| WO | WO2007/045826 | 4/2007 |
| WO | WO2007/045827 | 4/2007 |
| WO | WO2007/045828 | 4/2007 |
| WO | WO2007/045831 | 4/2007 |
| WO | WO2007/045832 | 4/2007 |
| WO | WO2007/045834 | 4/2007 |
| WO | WO2007/045835 | 4/2007 |
| WO | WO2007/045859 | 4/2007 |
| WO | WO 2007/052016 | 5/2007 |
| WO | WO 2007/064188 | 6/2007 |
| WO | WO 2007/064189 | 6/2007 |
| WO | WO 2007/064197 | 6/2007 |
| WO | WO 2007/064199 | 6/2007 |

OTHER PUBLICATIONS

International Search Report and Written Opinion in PCT/US2008/009661 dated Nov. 13, 2008.

International Search Report and Written Opinion in PCT/US2008/009663 dated Dec. 23, 2008.

JP 61232177. Partial English Translation. pp. 1-2.

JP 2003246380. Partial English Translation. pp. 1-8.

* cited by examiner

ACTUATOR CAP FOR A SPRAY DEVICE

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Background

The present disclosure relates generally to discharging a fluid from a spray device, and more particularly, to an apparatus for discharging a fluid from a pressurized aerosol container.

2. Description of the Background of the Invention

A discharge device for an aerosol container typically includes an actuator mechanism for engaging a nozzle of the aerosol container. Conventional actuator mechanisms include motor driven linkages that apply downward pressure to depress the nozzle and open a valve within the container. Typically, these actuator mechanisms are unwieldy and are not readily adaptable to be used in a stand-alone manner and a hand-held manner. Further, many of these actuator mechanisms exhibit a great deal of power consumption.

One example of a conventional actuator for an aerosol container includes a base and a plate extending vertically therefrom. A bracket extends transversely from the plate and is adapted to support the container. A solenoid is mounted to the bracket over a top end of the container. A U-shaped bracket is affixed to a shaft of the solenoid and is movable between first and second positions. When the solenoid is energized the U-shaped bracket is forced downwardly into the second position to engage with and depress a valve stem of the container, thereby opening a valve within the container and causing the emission of fluid therefrom.

In another example, a device for automatically spraying a fluid from an aerosol container includes a valve unit mounted on a top end of the container. The valve unit includes an interiorly disposed valve and a vertically depressible valve rod for opening the valve. A floating valve is disposed within the device and is attached to the vertically depressible valve rod. A bi-metal member is disposed within the device and is adapted to snappingly change its shape dependent on the level of heat provided to same. During an in use condition, the bi-metal member forces the floating valve downwardly to open the valve and allow the discharge of fluid from the container.

In yet another example, a spray dispenser utilizes a bi-metallic member to vertically actuate a plunger or valve stem to release an aerosolized fluid from within a container.

Further, a different example includes an overcap having an actuator mechanism with a vertically actuable plunger mounted thereon. The overcap is mounted onto a top end of an aerosol container, wherein the container includes a valve element extending outwardly therefrom. The valve element is vertically depressible between a first closed position and a second open position. During use, a signal is received by the actuator mechanism to cause a solenoid to drive the plunger downwardly and vertically depress the valve stem, thereby causing the emission of fluid through an outlet of the valve element.

In still another example, a flexible nozzle for filling containers with a fluid includes a nozzle with four flaps. A marmen wire is integrated into each of the four flaps. The marmen wire is made from a transformable material such as nitinol or a piezoelectric material. Upon the application and removal of heat or electricity to the marmen wire, same transforms alternatively between a contracted and an extended position to regulate the flow of fluid during a container filling process.

SUMMARY OF THE INVENTION

According to one embodiment of the present invention, an overcap for a dispenser includes a housing mountable on a container. The container includes a tilt-activated valve stem with a discharge end. The discharge end of the valve stem is adapted to be in fluid communication with a discharge orifice of the housing. A drive unit is disposed within the housing, wherein the drive unit includes a bi-metallic actuator, a piezo-linear motor, or an electro-responsive wire, which is adapted to impart transverse motion to the valve stem to open a valve of the container.

According to another embodiment of the present invention, an overcap for a dispenser includes a housing adapted to be mounted on a container having a tilt activated valve stem. The housing includes a discharge orifice. A dispensing member is adapted to be disposed on a portion of the valve stem, wherein a conduit of the dispensing member is in fluid communication with a discharge end of the valve stem and the discharge orifice of the housing. A drive unit is disposed within the housing, wherein the drive unit includes a solenoid adapted to impart transverse motion to the dispensing member.

According to a different embodiment of the present invention, an actuator for a dispenser includes a container having a tilt-activated valve stem with a discharge orifice. A dispensing member is disposed on a portion of the valve stem, wherein a conduit of the dispensing member is in fluid communication with the discharge orifice of the valve stem. A drive unit is provided having means for engaging the dispensing member to place the tilt-activated valve stem in an operable position.

Other aspects and advantages of the present invention will become apparent upon consideration of the following detailed description.

DETAILED DESCRIPTION OF THE DRAWINGS

Figure 1:
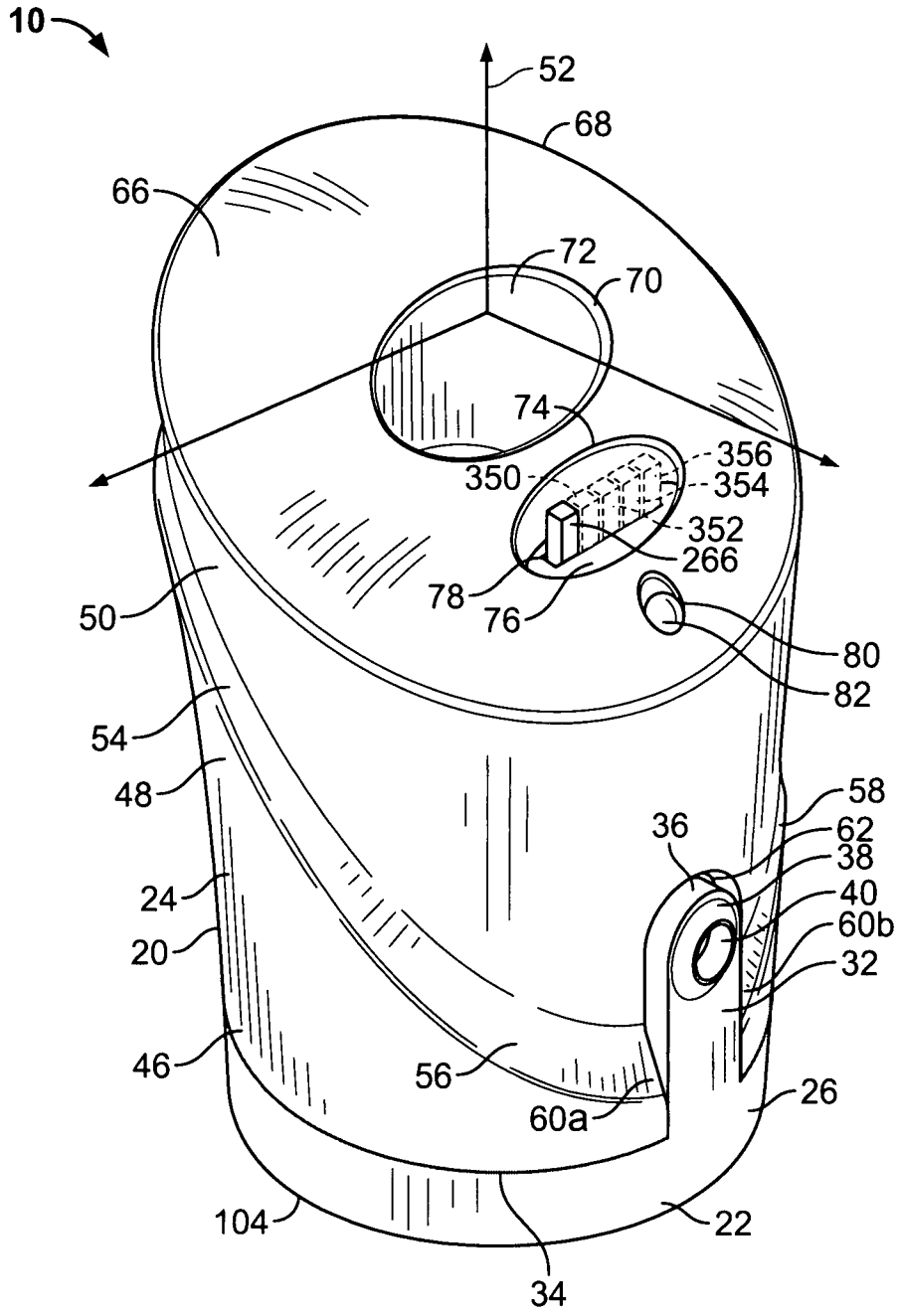
FIG. 1 is an isometric view of one embodiment of an actuator overcap.
Figure 3:
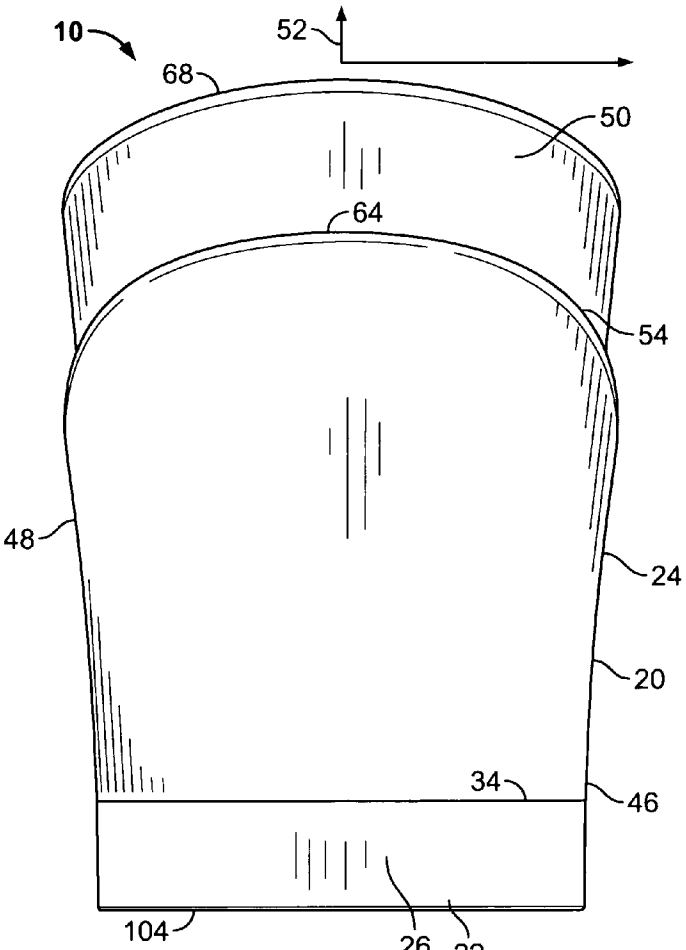
FIG. 3 is a rear elevational view of the overcap of FIG. 1.
Figure 2:
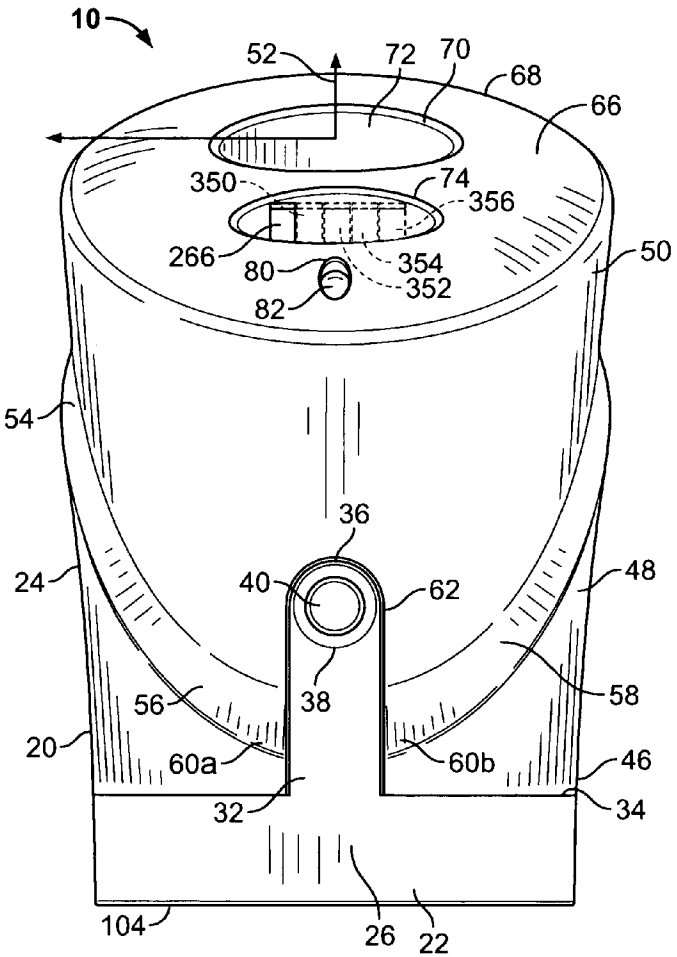
FIG. 2 is a front elevational view of the overcap of FIG. 1.
Figure 5:
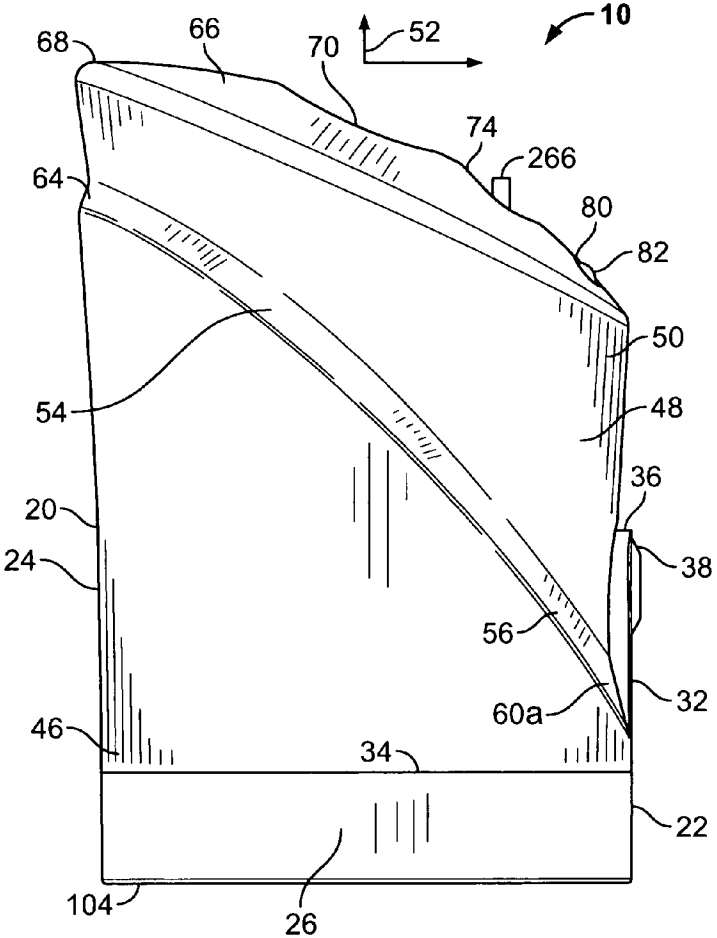
FIG. 5 is a left side elevational view of the overcap of FIG. 1.
Figure 4:
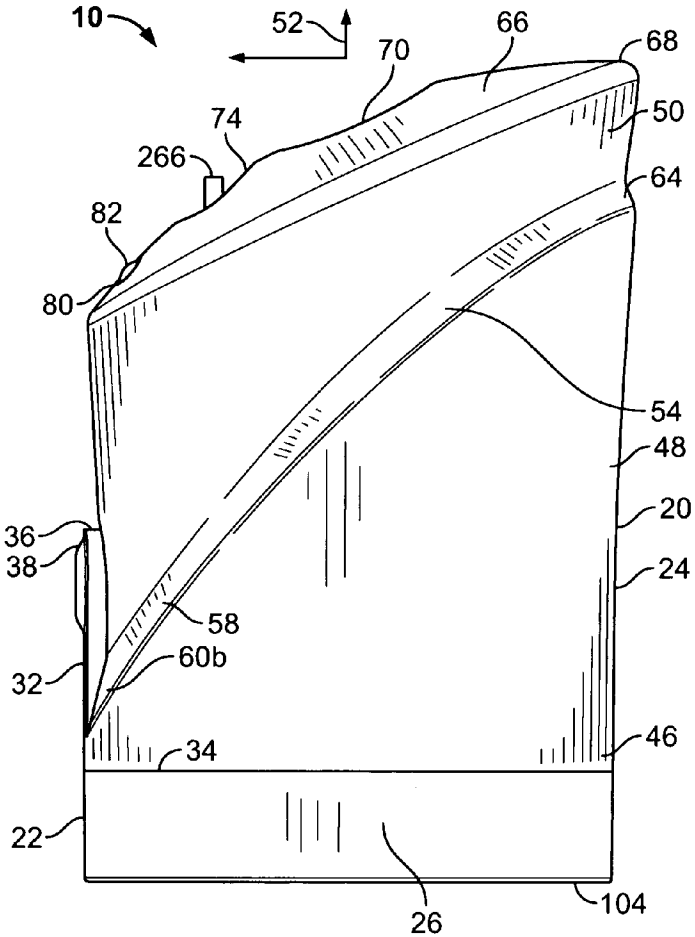
FIG. 4 is a right side elevational view of the overcap of FIG. 1.
Figure 6:
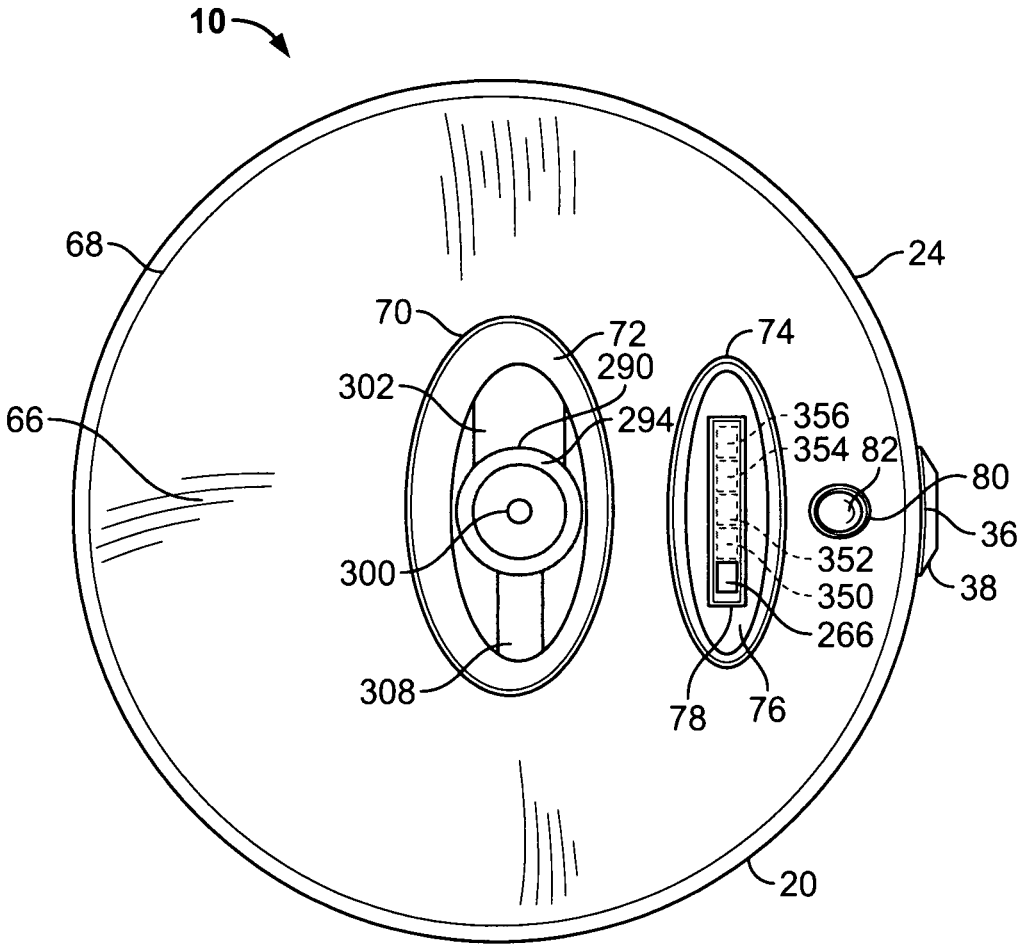
FIG. 6 is a top plan view of the overcap of FIG. 1.
Figure 7:
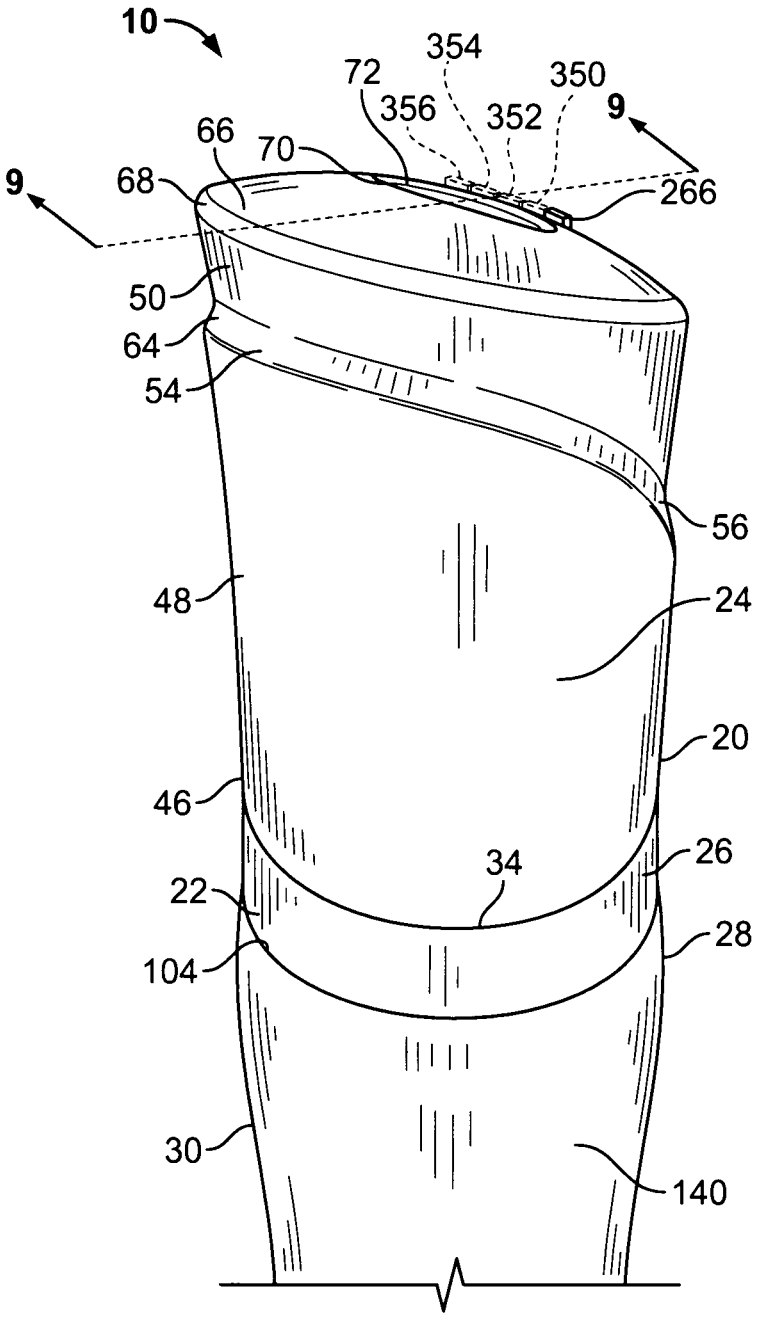
FIG. 7 is an isometric view of the overcap of FIG. 1 mounted on a fluid container.
Figure 8:
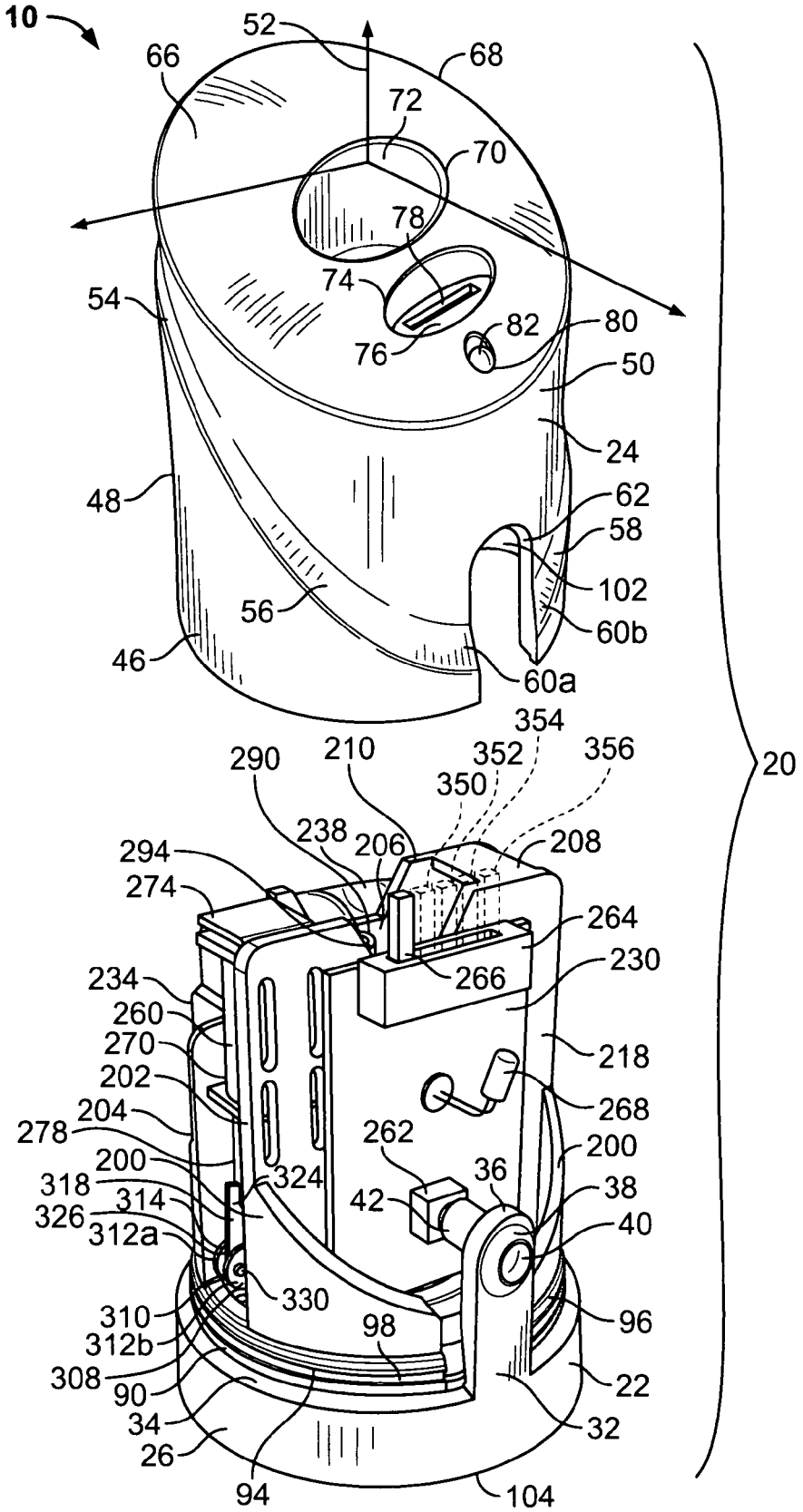
FIG. 8 is an exploded isometric view of the overcap of FIG. 1 showing a removable cap and a bracket.

FIGS. 1-6 depict an actuator overcap 10 having a generally cylindrical housing 20. The housing 20 includes a base portion 22 and a removable cap 24. The base portion 22 comprises a cylindrical section 26 adapted to be retained on an upper end 28 of a conventional aerosol container 30, which is shown in FIG. 7 and will be described in further detail below. A post 32 extends upwardly from a top end 34 of the cylindrical section 26. The post 32 includes a curved distal end 36 with an oval pushbutton 38 on an outer wall thereof. The pushbutton 38 is further provided with a concave depression 40. A cylindrical rod 42 (see FIG. 8) is provided on an inner wall 44 of the post 32 generally opposite the pushbutton 38.

The removable cap 24 includes a cylindrical bottom portion 46, which has a diameter substantially equal to that of the top end 34 of the cylindrical section 26. A sidewall 48 extends between the bottom portion 46 of the cap 24 and a top portion 50 thereof. The sidewall 48 tapers outwardly about a longitudinal axis 52 of the cap 24 so that a cross-sectional diameter of the cap 24 adjacent the bottom portion 46 is smaller than a cross-sectional diameter of the cap 24 adjacent the top portion 50. The uniform tapering of the cap 24 is truncated by a stepped portion 54. The stepped portion 54 includes first and second tapered surfaces 56, 58, respectively, that extend inwardly toward the longitudinal axis 52 of the cap 24. The first and second tapered surfaces 56, 58 include first ends 60a, 60b, respectively, disposed on opposing sides of a groove 62 adjacent the bottom portion 46 of the cap 24. The tapered surfaces 56, 58, curve upwardly from the first ends 60a, 60b toward a portion 64 of the cap 24 opposite the groove 62 and adjacent the top portion 50.

An upper surface 66 of the removable cap 24 is convex and is bounded by a circular peripheral edge 68. An elliptical shaped discharge orifice 70 is centrally disposed within the upper surface 66. A frusto-conical wall 72 depends downwardly into an interior of the cap 24 about a periphery of the discharge orifice 70. A curved groove 74 is disposed between the discharge orifice 70 and the peripheral edge 68. The groove 74 includes a flat bottom 76 with a rectangular notch 78 disposed therein. An aperture 80 is also provided between the groove 74 and the peripheral edge 68. A light transmissive rod 82 is held within the aperture 80 by an interference fit.

Figure 9:
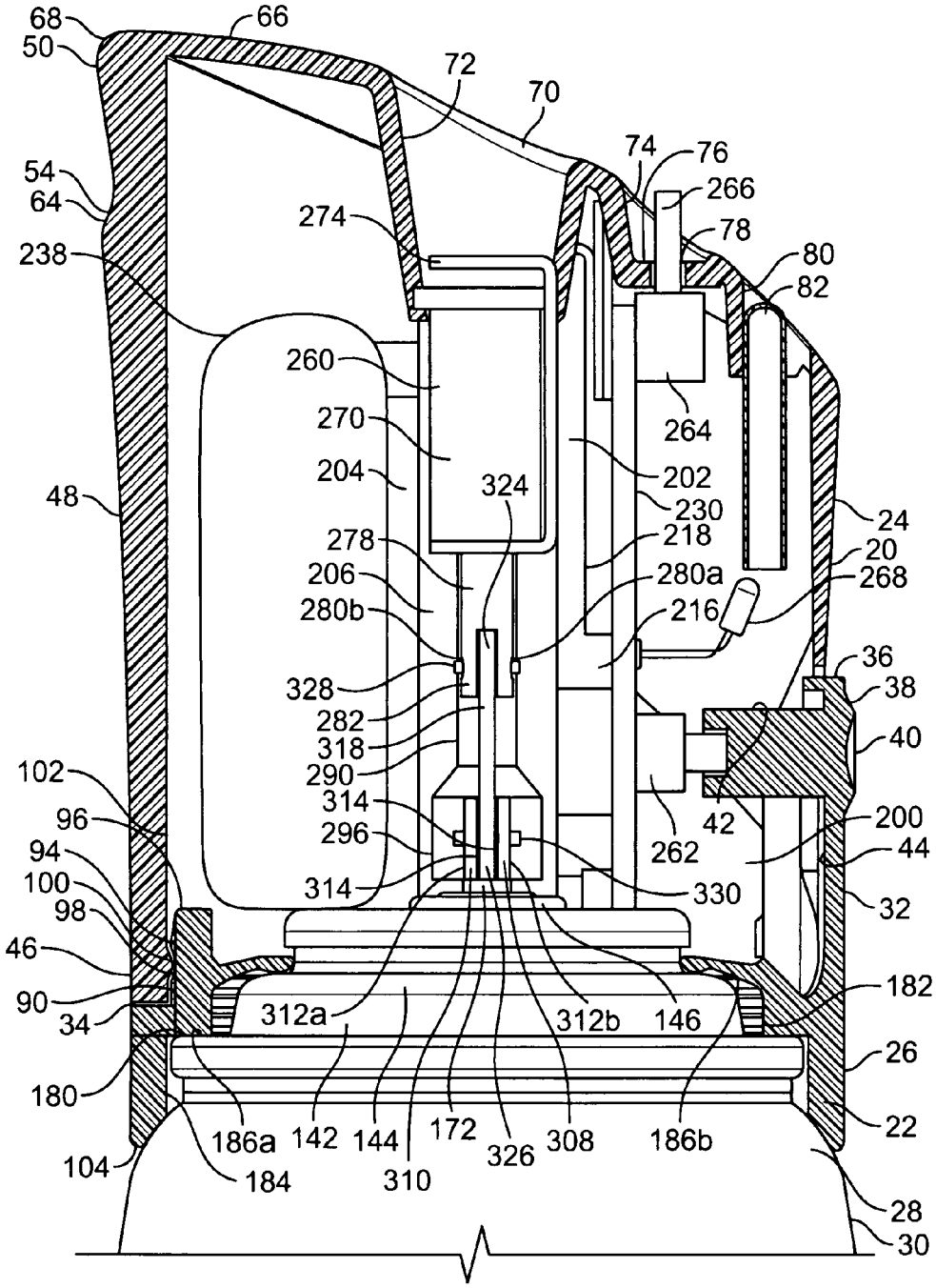
FIG. 9 is an enlarged elevational view partly in section taken along the lines 9-9 of FIG.7 with a portion of a bracket removed for purposes of clarity.

As shown in FIGS. 8-16, the base portion 22 includes a platform 90 that is disposed on the top end 34 of the cylindrical section 26. The platform 90 is sized to frictionally engage with the bottom portion 46 of the removable cap 24 when the cap 24 is attached to the base portion 22. FIG. 9 illustrates that the platform 90 comprises an inwardly stepped portion, which includes a sidewall 94 and a top portion 96. The sidewall 94 includes a circumferential notch 98 adapted to fittingly receive an annular portion 100 on an inner wall 102 of the cap 24 adjacent the bottom portion 46 thereof. Further, additional retention support is provided by the groove 62, which is sized to fittingly receive the post 32 when the cap 24 is placed on the base portion 22. During the placement of the cap 24 on the section 26, the user aligns the groove 62 with the post 32 and slides the cap 24 downwardly until same contacts the top end 34 of the base portion 22 and forms an interference fit with the platform 90. A bottom end 104 of the base portion 22 is also shaped to fit on the upper end 28 of the aerosol container 30. In another embodiment of the overcap 10, the cap 24 and the base portion 22 form an integral unit that is attached to the top of the container 30 by an interference fit. Indeed, regardless of whether the housing 20 comprises one or more components, the housing 20 may be retained on the container 30 in any manner known by those skilled in the art. For example, the overcap retention structures described in U.S. Pat. Nos. 4,133,448, 5,027,982, and 5,649,645, which are herein incorporated by reference in their entirety, may be used in connection with any of the embodiments described herein. Further, any of the aesthetic aspects of the overcap 10 described herein may be modified in any manner known by one skilled in the art, e,g, the stepped portion 54 could be removed or the housing 20 could be provided with a different shape.

The overcap 10 discharges fluid from the container 30 upon the occurrence of a particular condition. The condition could be the manual actuation of the overcap 10 or the automatic actuation of the overcap 10 in response to an electrical signal from a timer or a sensor. The fluid discharged may be a fragrance or insecticide disposed within a carrier liquid, a deodorizing liquid, or the like. The fluid may also comprise other actives, such as sanitizers, air fresheners, odor eliminators, mold or mildew inhibitors, insect repellents, and/or the like, and/or that have aromatherapeutic properties. The fluid alternatively comprises any fluid known to those skilled in the art that can be dispensed from a container. The overcap 10 is therefore adapted to dispense any number of different fluid formulations.

The container 30 may be an aerosol container of any size and volume known to those skilled in the art. However, the container 30 preferably comprises a body 140 (see FIG. 17) with a mounting cup 142 crimped to the upper end 28 thereof.

The mounting cup 142 is generally cylindrical in shape and includes an outer wall 144 that extends circumferentially therearound. A pedestal 146 extends upwardly from a central portion of a base 148 of the mounting cap 142. A valve assembly within the container 30 includes a valve stem 172 extending upwardly from the pedestal 146. The valve stem 172 is of the tilt-activated type similar to the one described in U.S. Pat. No. 4,068,782, which is herein incorporated by reference in its entirety. When a distal end of the valve stem 172 is tilted away from the longitudinal axis 52 of the container 30 to a sufficient degree, i.e., into an operable position, the valve assembly is opened and the contents of the container 30 are discharged through a discharge orifice or end (not shown) in the valve stem 172. The contents of the container 30 may be discharged in a continuous or metered dose. Further, the discharging of the contents of the container 30 may be effected in any number of ways, e.g., a discharge may comprise a partial metered dose or multiple consecutive discharges.

It is particularly advantageous to use a tilt-activated valve stem in connection with the present embodiments as opposed to a vertically activated valve stem. One advantage in using a tilt-activated valve stem is that a smaller force is required to place the valve stem in an operable position as compared to vertically activated valve stems. Smaller activation forces translate into decreased power consumption by the particular drive mechanism used, which will allow for simpler, smaller, and/or less costly drive mechanisms. Further, decreased power consumption will allow for longer power source life times. These and other advantages will be readily apparent to one skilled in the art upon reading the present disclosure.

As noted above, the housing 20 is adapted to be retained on the upper end 28 of the container 30. FIG. 9 shows that the present embodiment includes recesses 180, 182 around an inner circumference 184 of the base portion 22. The recesses 180, 182 are defined by surfaces 186a, 186b that form an interference fit with the mounting cup 142 and a neck, respectively, of the container 30 when the base portion 22 is operably attached to the container 30.

Turning to FIGS. 10-16, a bracket 200 is shown extending upwardly from the platform 90. The bracket 200 includes a first wall 202 and a second wall 204 that is parallel to and spaced apart from the first wall 202 to define a channel 206. A first plate 208 is disposed between the first and second walls 202, 204 at a distal end 210 of the channel 206. A rib 216 is provided on an outer surface 218 of the first wall 202 for the support of a printed circuit board 230 having a control circuit disposed thereon. The second wall 204 is provided with first and second frame members 234, 236 on opposing sides thereof. The first and second frame members 234, 236 are adapted to retain a D.C. power source 238 comprising a set of three AA batteries therein. The power source 238 of the present embodiment is shown schematically to illustrate the interchangeability of the batteries with other power sources. In some embodiments, the AA batteries can be replaced by a rechargeable Nickel-Cadmium battery pack having an electrical lead 242 that can be used to connect the battery pack to an A.C. power outlet 244, such as seen in FIG. 17. In another embodiment, the D.C. power source 238 may be entirely replaced by an A.C. power adapter having an appropriate power transformer and A.C./D.C. converter as known to those of skill in the art.

Figure 18A:
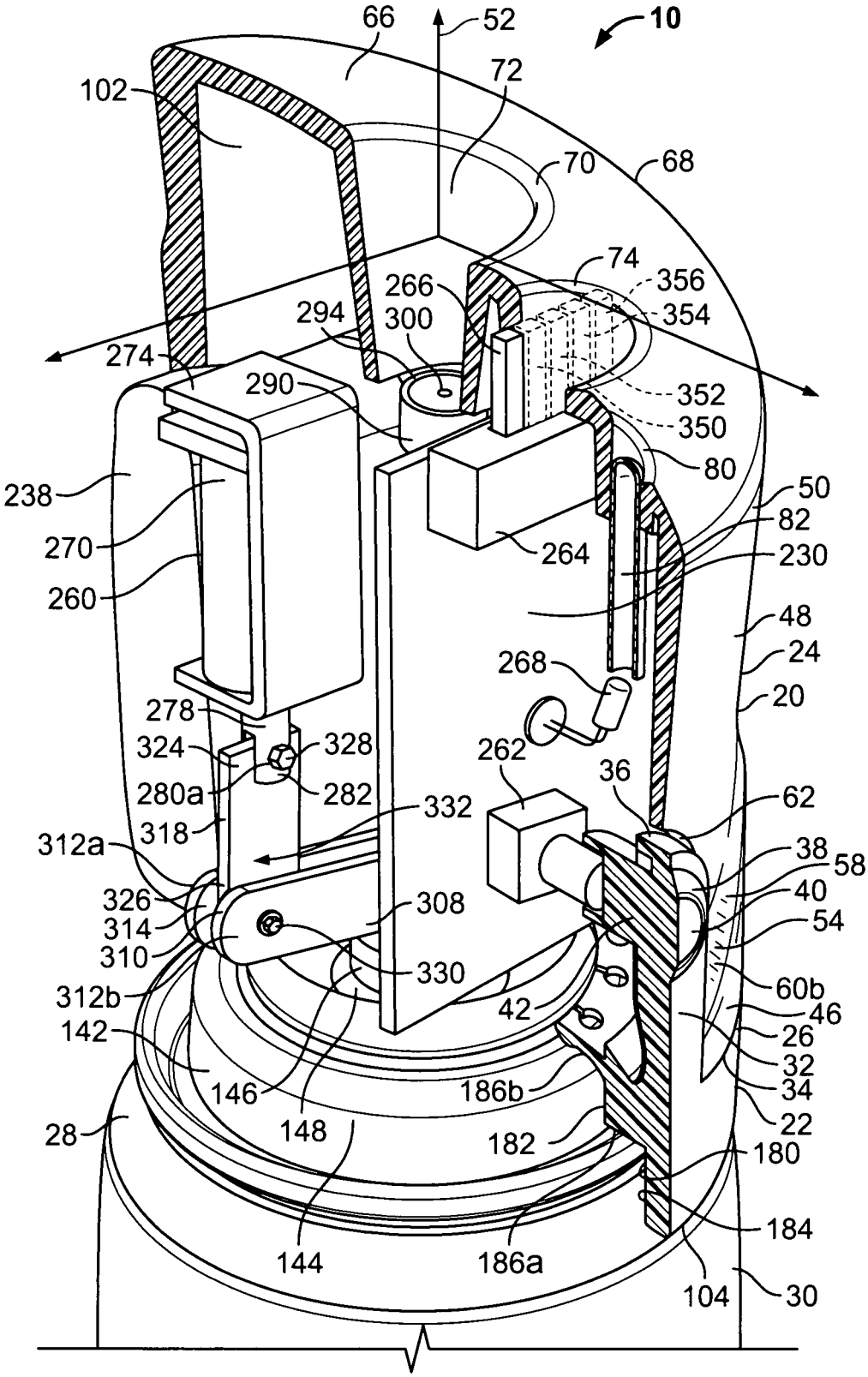
FIGS. 18A and 18B illustrate pre-actuation and post actuation positions, respectively, of a solenoid within the overcap of FIGS. 1-16, with a bracket removed from the overcap for purposes of clarity.
Figure 18B:
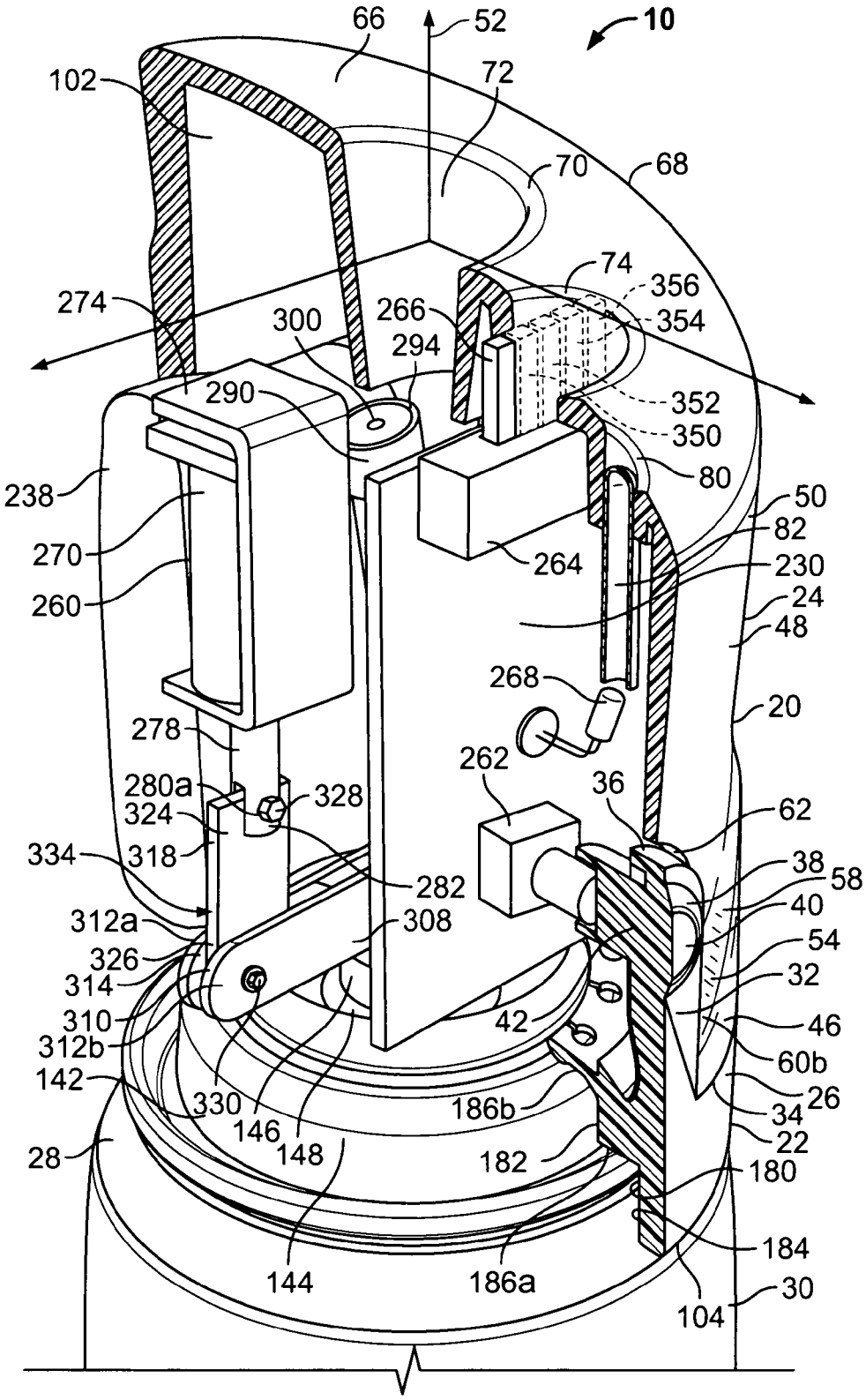

The control circuit allows for the electrical actuation of a drive mechanism or a drive unit 260 to cause the discharge of fluid from the container 30. FIGS. 18A and 18B depict a switch 262 disposed on the printed circuit board 230. The switch 262 is operably aligned with the pushbutton 38 such that the manual depression of the pushbutton 38 causes the actuation of the switch 262. Further, a user selectable switch assembly 264 is disposed adjacent a top portion of the printed circuit board 230. The user selectable switch assembly 264 includes a finger 266 extending upwardly therefrom. The finger 266 may be used to select different operating modes for the circuit (as discussed in greater detail below). The finger 266 fits within the notch 78 when the cap 24 is engaged with the base portion 22 such that a user can operatively interact with the finger 266. A light emitting diode (LED) 268 disposed on the printed circuit board 230 is positioned proximate the light transmissive rod 82 of the cap 24.

As illustrated in FIGS. 8, 9, 11, 15, 16, 18A, and 18B, a drive unit 260 in the form of a solenoid 270 is disposed within the channel 206. In the present embodiment, the solenoid 270 is a Ledex® C Frame, Size C5, D.C. operated solenoid sold by Saia-Burgess Inc., of Vandalia, Ohio. However, other solenoids known to one of ordinary skill in the art may be employed without deviating from the principles described herein. For instance, the solenoid 270 could be a solenoid manufactured by Tri-Tech, LLC, of Mishawaka, Ind., such as the Series 1551 Solenoid Actuator. The solenoid 270 includes a mounting brace 274 that is attached to the first wall 202 by screws (not shown). An armature 278 extends downwardly from the solenoid 270 toward the platform 90. In the present embodiment, the armature 278 is substantially parallel to the valve stem 172 and the longitudinal axis 52 of the container 30. The armature 278 includes slots 280*a*, 280*b* at a distal end 282 thereof.

Figure 10:
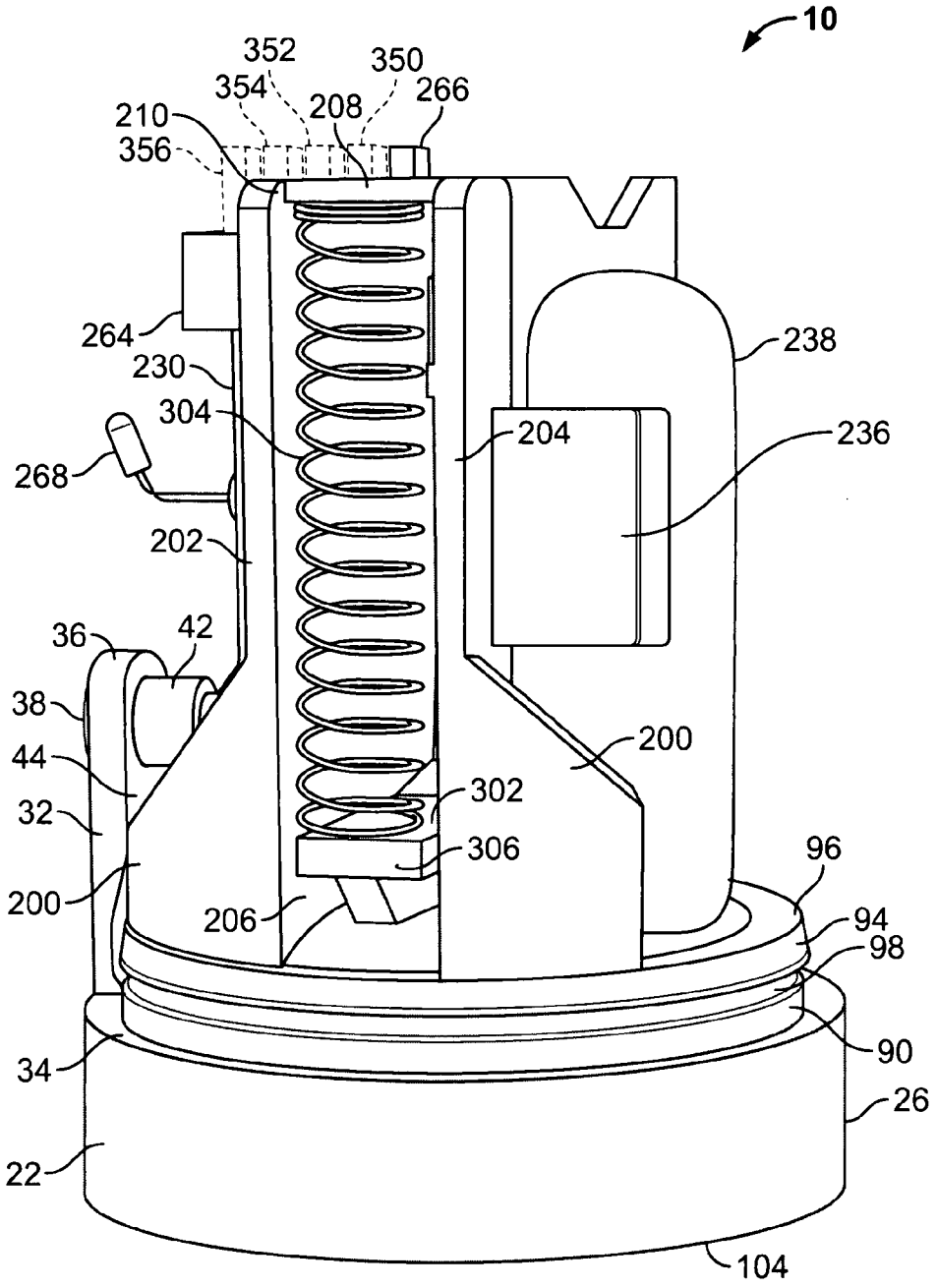
FIG. 10 is an isometric view of the overcap of FIG. 1 with a portion of a housing removed.
Figure 11:
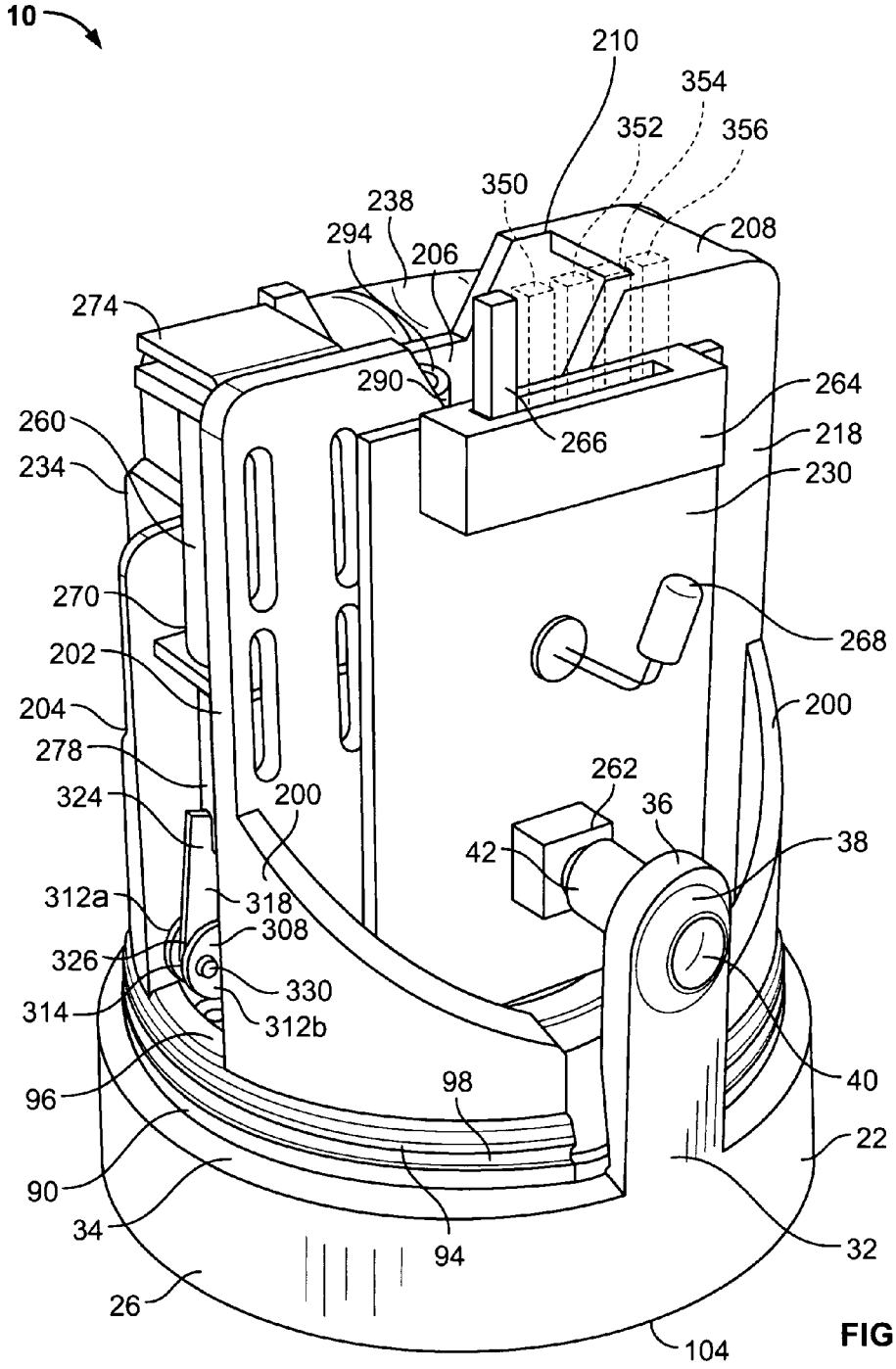
FIG. 11 is a different isometric view of the overcap of FIG. 10.
Figure 12:
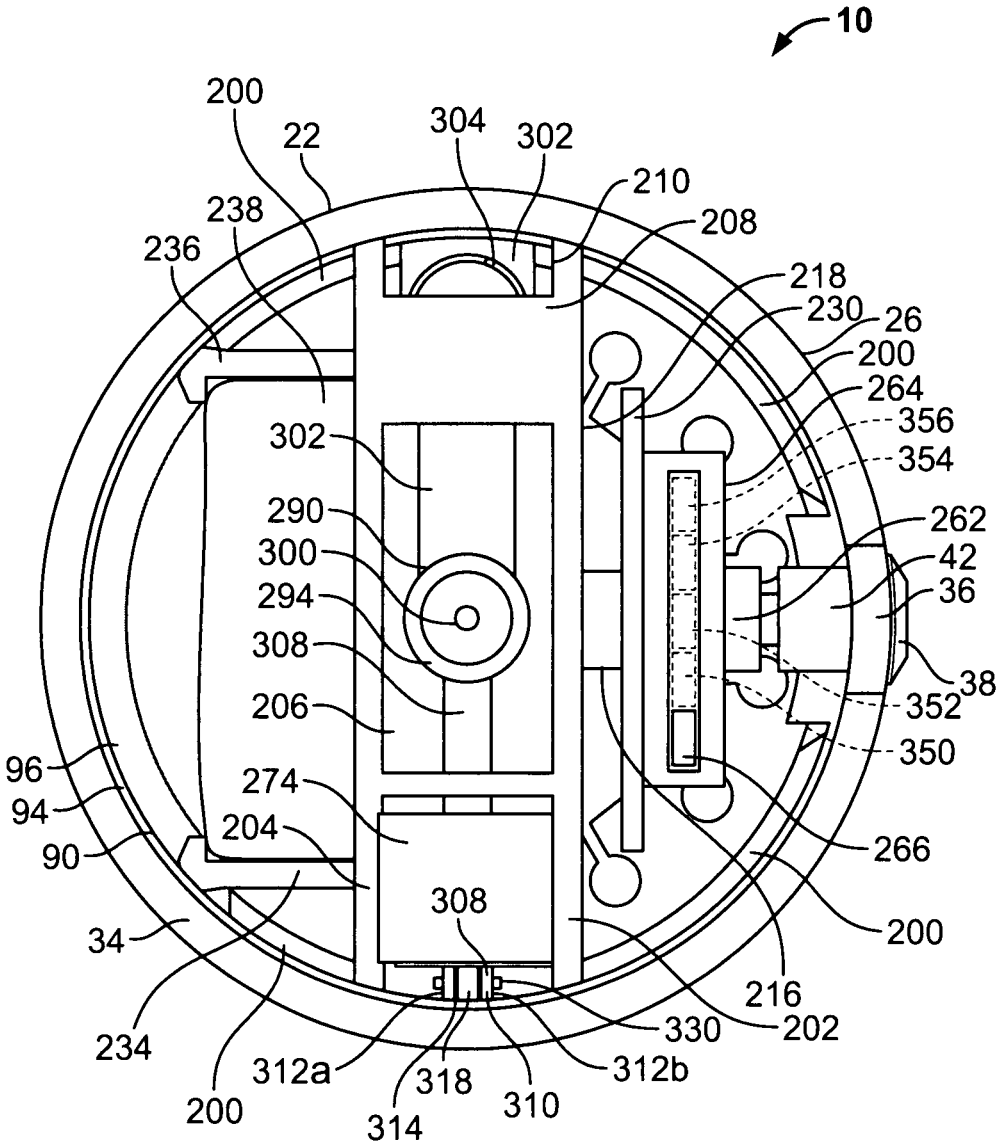
FIG. 12 is a top plan view of the overcap of FIG. 10.
Figure 13:
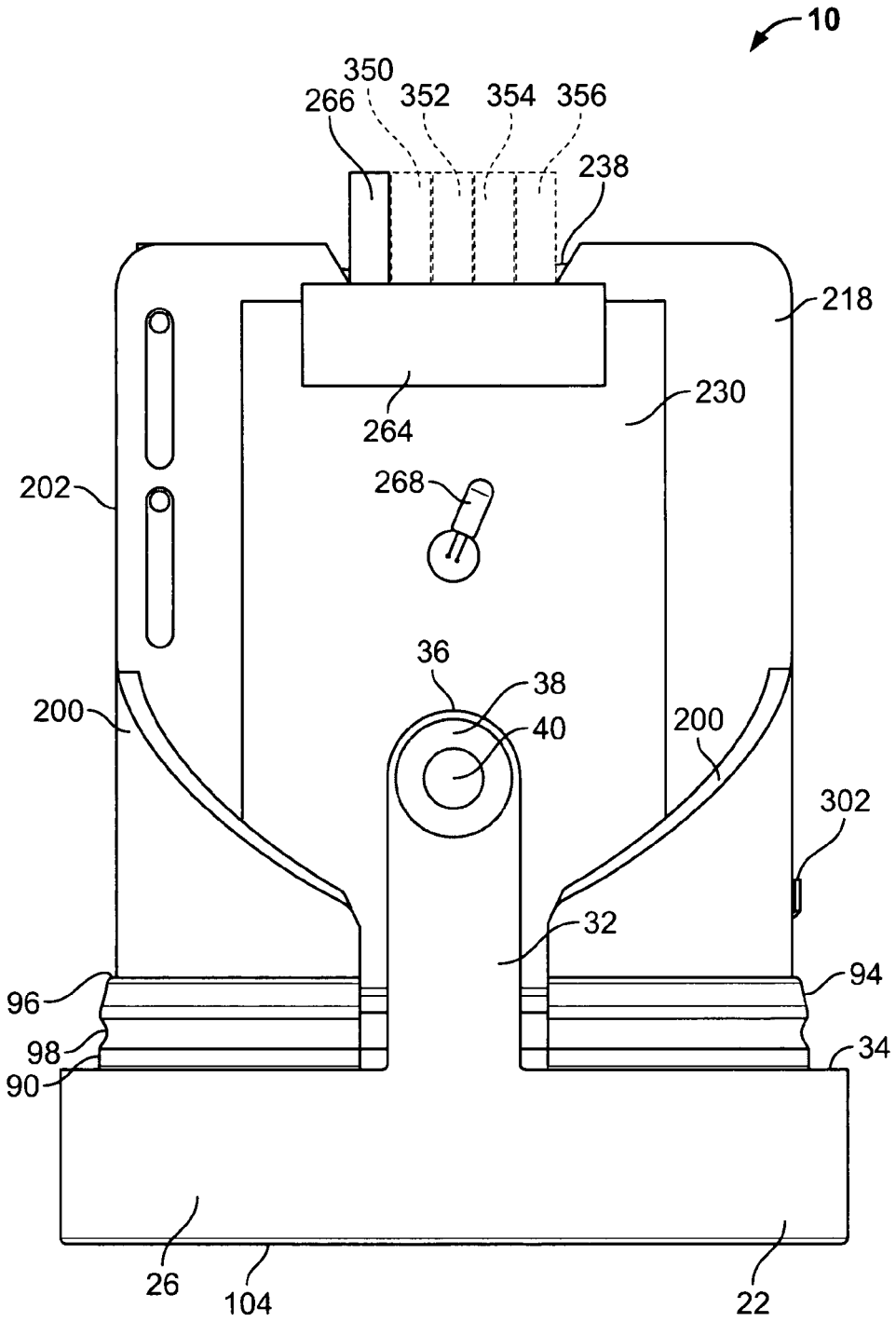
FIG. 13 is a front elevational view of the overcap of FIG. 10.
Figure 14:
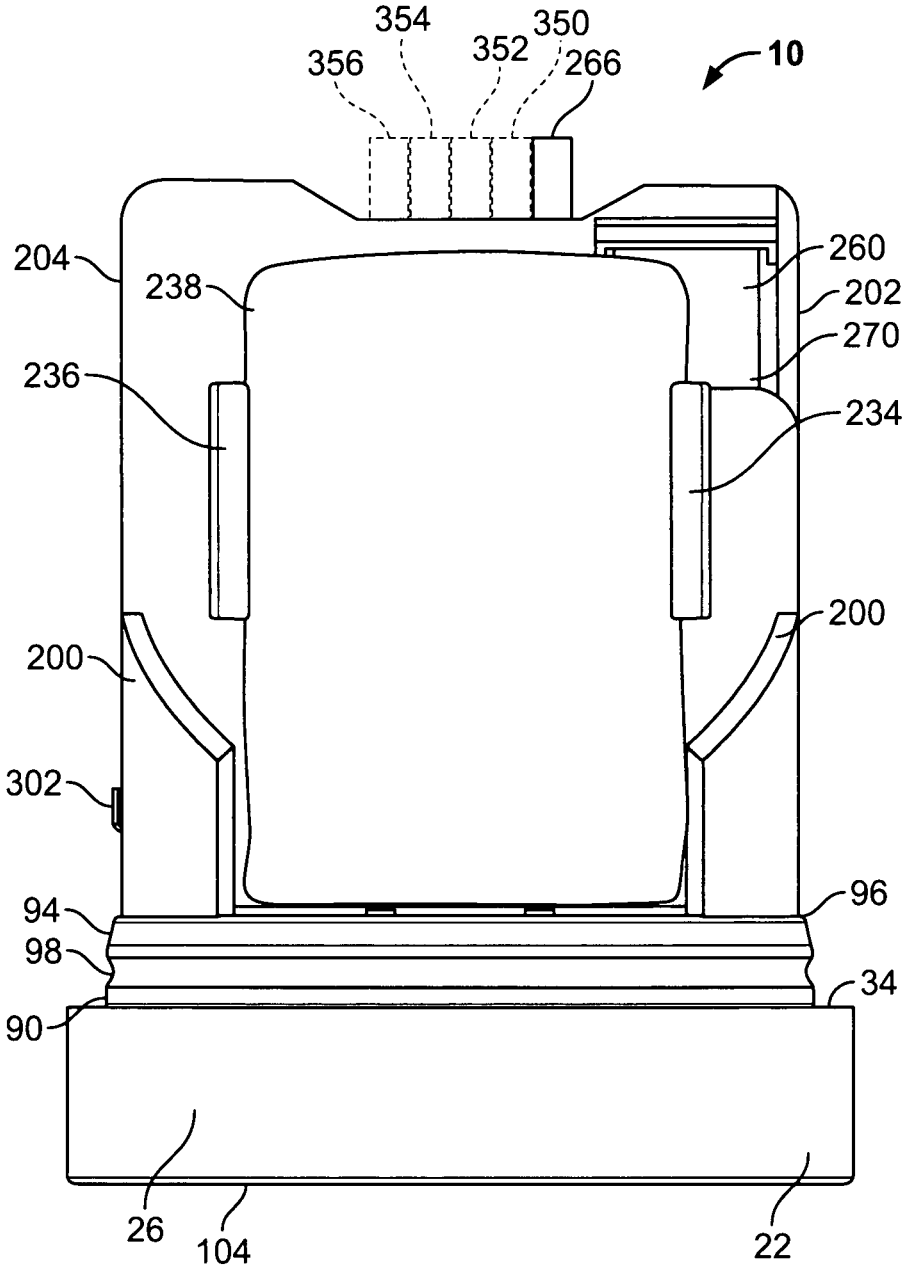
FIG. 14 is a rear elevational view of the overcap of FIG. 10.
Figure 15:
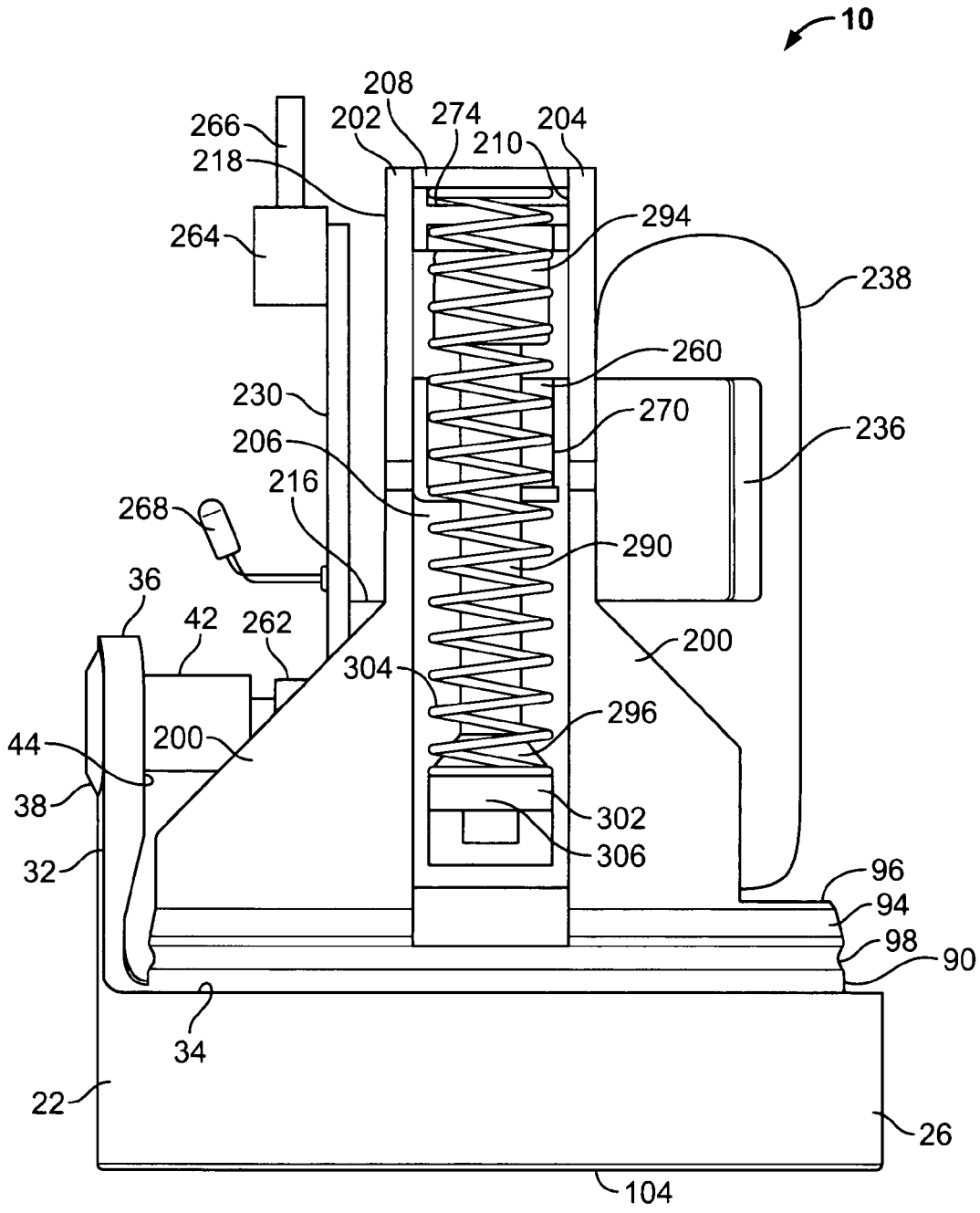
FIG. 15 is a right side elevational view of the overcap of FIG. 10.

With particular reference to FIGS. 9, 12, 15, and 16, a dispensing member 290 is shown. In the present embodiment, the dispensing member 290 comprises a cylindrical member having top and bottom ends 294, 296 respectively. With reference to FIG. 9, when the housing 20 is placed on the container 30, the distal end of the valve stem 172 is seated within a circular opening (not shown) adjacent the bottom end 296 of the dispensing member 290. A bore 300 extends from the opening and through the top end 294 of the dispensing member 290, as may be seen in FIG. 12. In other embodiments, the dispensing member 290 comprises a non-cylindrical shape and/or includes varying cross-sectional dimensions throughout an entire or partial length of the member 290, e.g., a discharge end of the bore 300 may be narrower than other portions of the bore 300 or may be angled with respect to other portions of the bore 300. Further, all or part of the bore 300 extending the length of the dispensing member 290 may be cylindrical or any other shape, e.g., a discharge end of the bore 300 adjacent the top end 295 of the dispensing member 290 may be square. The top end 294 of the dispensing member 290 is disposed adjacent to and/or within the frustoconical wall 72 depending from the discharge orifice 70. The dispensing member 290 is appropriately centered to align the top end 294 of the member 290 with the discharge orifice 70. FIGS. 10, 12, and 15 show that the dispensing member 290 also includes an arm 302 extending transversely therefrom. A helical spring 304 is secured within the channel 206 by an interference fit between the first plate 208 and a distal end 306 of the arm 302. FIGS. 9, 11, 12, and 16 depict a second arm or bell crank 308, which similarly extends transversely from the dispensing member 290.

Figure 16:
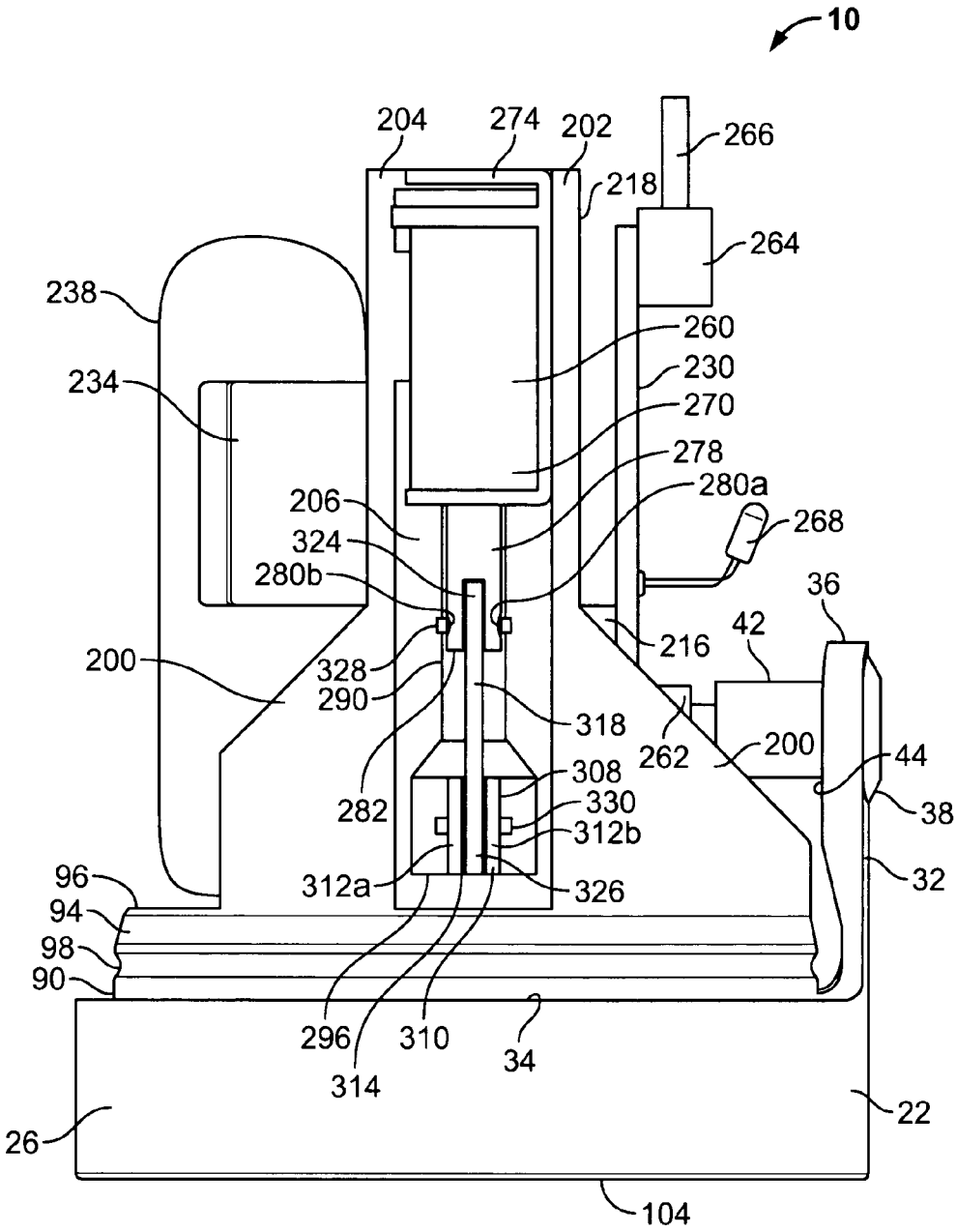
FIG. 16 is a left side elevational view of the overcap of FIG. 10.
Figure 17:
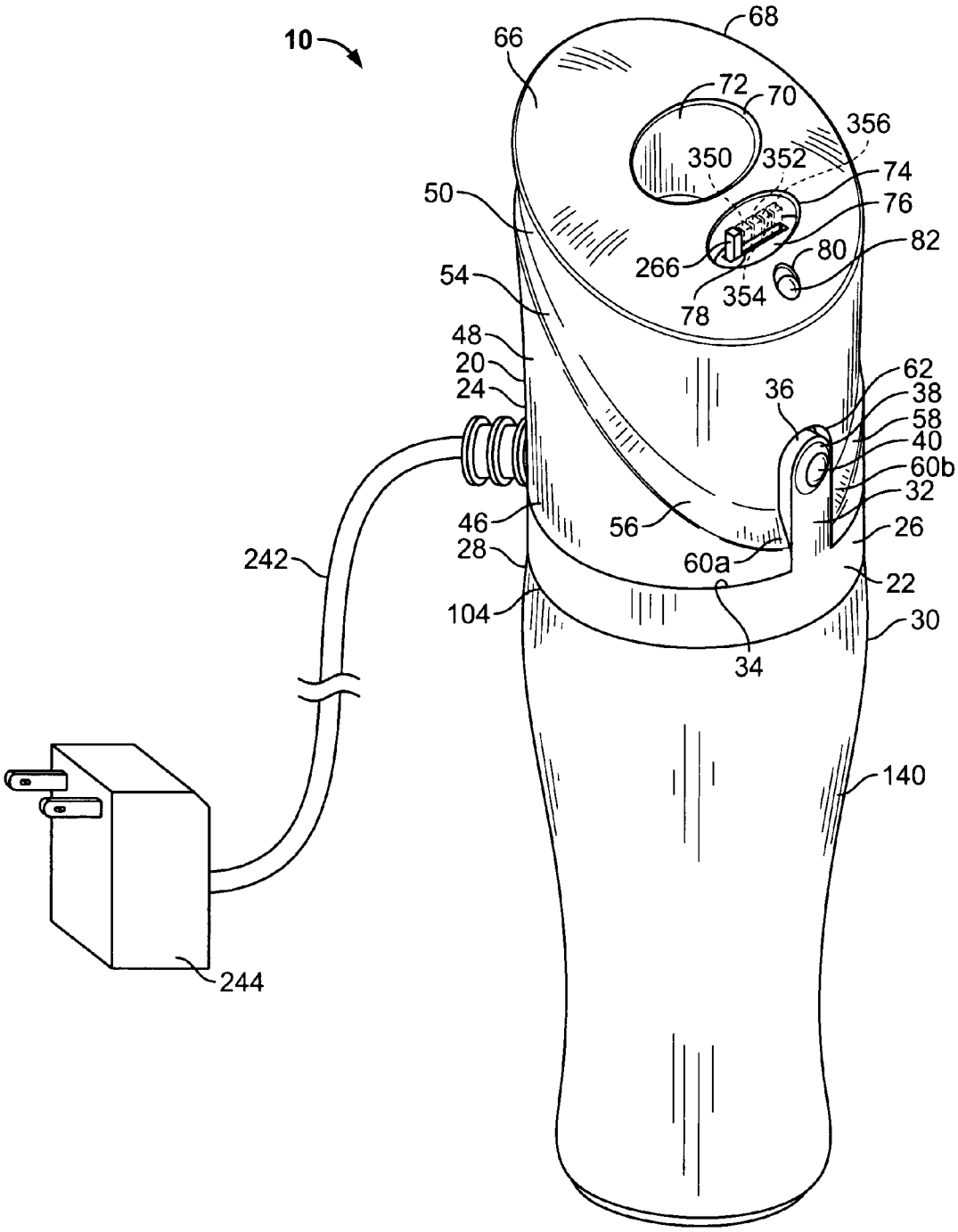
FIG. 17 is another embodiment of an overcap similar to the one depicted in FIG. 1, which includes an A.C. power connector.

With reference to FIGS. 9 and 16, a distal end 310 of the bell crank 308 includes two members 312*a*, 312*b* that define a groove 314. A connector 318 extends between the distal end 310 of the bell crank 308 and the distal end 282 of the armature 278. The connector 318 of the present embodiment comprises a rectangular plastic portion, however, it is anticipated that other shapes and materials may be used. The connector 318 includes holes on first and second ends 324, 326, respectively, thereof. A first pin 328 is inserted into the connector 318 adjacent the first end 324 thereof and the slots 280*a*, 280*b* of the armature 278. Similarly, a second pin 330 is inserted into the connector 318 adjacent the second end 326 thereof and holes within the bell crank 308. Therefore, the connector 318 mechanically connects the armature 278 to the bell crank 308.

Prior to opening the valve assembly and releasing the contents of the container 30, the armature 278, the connector 318, and the bell crank 308 are positioned in a pre-actuation position 332, such as shown in FIG. 18A. Preferably, when the overcap 10 is positioned in the pre-actuation position 332, the distal end of the valve stem 172 is parallel to the longitudinal axis 52 of the container 30. Alternatively, the dispensing member 290 and the valve stem 172 may be laterally displaced a distance insufficient to open the valve assembly. When the armature 278, the connector 318, and the bell crank 308 are transitioned to an actuation position 334, such as shown in FIG. 18B, the dispensing member 290 and the valve stem 172 are tilted a sufficient distance away from the longitudinal axis 52 of the container 30 to fully open the valve assembly. Alternatively, the valve stem 172 may be displaced into a partially open position when in the actuation position 334.

Turning to FIG. 18B, the actuation of the solenoid 270 with respect to the present embodiment will now be described with greater particularity. Upon the receipt of an actuation signal, the solenoid 270 is energized to magnetically drive the armature 278 downwardly along a path substantially parallel to the longitudinal axis 52 of the container 30. The linear motion of the armature 278 is translated into the rotational displacement of the bell crank 308 by the connector 318, which acts as a mechanical linkage therebetween. The rotational displacement of the bell crank 308 causes the dispensing member 290 to rotate about the longitudinal axis 52. Similarly, the rotation of the dispensing member 290 causes the bottom end 296 thereof to engage with and rotationally displace the valve stem 172 by applying a force transverse to the longitudinal axis 52, thereby forcing the valve stem 172 into the actuation position 334. Upon deactivation of the solenoid 270, the armature 278 is forced upwardly into the solenoid 270, thereby allowing the connector 318 and the bell crank 308 to return to the pre-actuation position 332 described above. Without any transverse forces acting upon the valve stem 172 to hold same in an open state, the valve stem 172 returns to a closed position substantially parallel to the longitudinal axis 52 of the container 30 and prevents fluid discharge. The return of the valve stem 172 to the closed position may be effected by one or more of the spring 304, forces exerted by the mechanically linked armature 278, and forces exerted by the valve assembly in the container 30.

It is anticipated that the solenoid 270 will be driven for an appropriate duration and/or appropriately displaced to fully or partially open the valve stem 172. Specific distances traveled by and/or the lengths of any of the elements, e.g., the armature 278, the connector 318, and the bell crank 308, may be modified in a manner known to those skilled in the art to adjust the mechanical relationship between the elements and to effect a partial or complete tilting of the valve stem 172. Preferably, although not necessarily, the armature 278 is held in the discharge position for a predetermined length of time ("spraying period"). The duration of the spraying period is typically equal to about 170 milliseconds. Indeed, if desired, the armature 278 could be held in the discharge position until all of the container contents are exhausted. Further, the armature 278 may be displaced multiple times in response to the occurrence of a single actuation signal to provide for multiple sequential discharges. Multiple sequential discharges may be beneficial when a single discharge from a continuously discharging container is undesirable or when intermittent discharge is desired.

Figure 19:
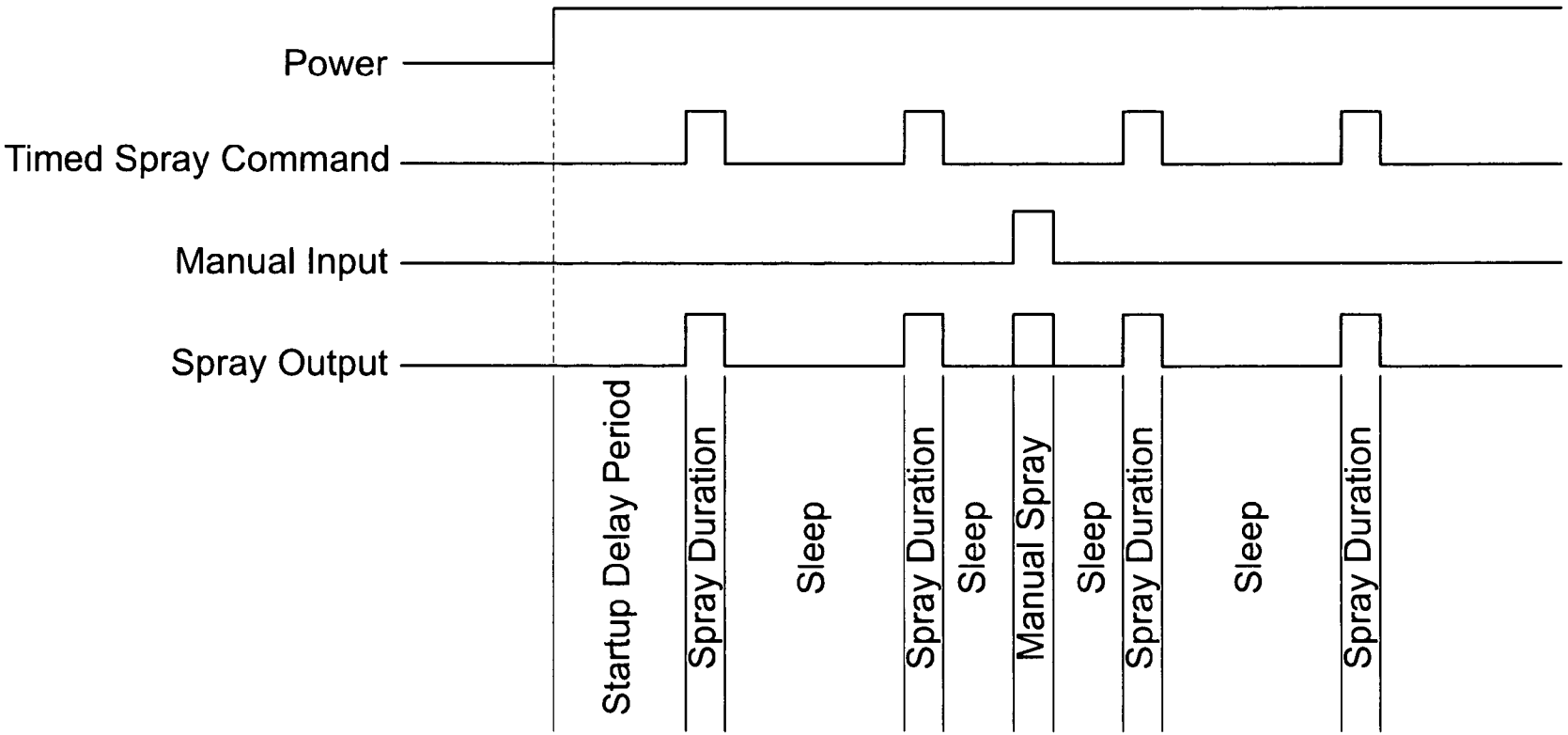
FIG. 19 is a timing diagram illustrating the operation of the overcap of FIGS. 1-16 according to a first operational sequence.

FIG. 19 depicts a timing diagram of the present embodiment that illustrates the operation of the overcap 10 during an in use condition. Initially, the overcap 10 is energized by moving the finger 266 from an "OFF" position to one of four operating modes 350, 352, 354, 356, (see FIGS. 18A and 18B) whereupon the overcap 10 enters a startup delay period. Each of the four operating modes 350, 352, 354, 356 corresponds to a predetermined sleep period between consecutive spraying periods. For example, the first operating mode 350 can correspond to a five minute sleep period, the second operating mode 352 can correspond to a seven and a half minute sleep period, the third operating mode 354 can correspond to a fifteen minute sleep period, and the fourth operating mode 356 can correspond to a thirty minute sleep period. For the present example, we shall assume the first operating mode 350 has been chosen. Upon completion of the startup delay period, the solenoid 270 is directed to discharge fluid from the overcap 10 during a first spraying period. The startup delay period is preferably about three seconds long, and the spraying period is typically about 170 milliseconds long. Upon completion of the first spraying period, the overcap 10 enters a first sleep period that lasts 5 minutes. Upon expiration of the first sleep period the solenoid 270 is actuated to discharge fluid during a second spraying period. Thereafter, the overcap 10 enters a second sleep period that lasts for 5 minutes. In the present example, the second sleep period is interrupted by the manual actuation of the overcap 10, whereupon fluid is dispensed during a third spraying period. Automatic operation thereafter continues with alternating sleep and spraying periods. At any time during a sleep period, the user can manually actuate the overcap 10 for a selectable or fixed period of time by depressing the pushbutton 38. Upon termination of the manual spraying operation, the overcap 10 completes the pending sleep period. Thereafter, a spraying operation is undertaken.

In another embodiment, the switch assembly 264 may be replaced and/or supplemented by a photocell motion sensor. Other motion detectors known to those of skill in the art may also be utilized e.g., a passive infrared or pyro-electric motion sensor, an infrared reflective motion sensor, an ultrasonic motion sensor, or a radar or microwave radio motion sensor. The photocell collects ambient light and allows the control circuit to detect any changes in the intensity thereof. Filtering of the photocell output is undertaken by the control circuit. If the control circuit determines that a threshold light condition has been reached, e.g., a predetermined level of change in light intensity, the control circuit develops a signal to activate the solenoid 270. For example, if the overcap 10 is placed in a lit bathroom, a person walking past the sensor may block a sufficient amount of ambient light from reaching the sensor to cause the control circuit to activate the solenoid 270 and discharge a fluid.

It is also envisioned that the switch assembly 264 may be replaced or supplemented with a vibration sensor, an odor sensor, a heat sensor, or any other sensor known to those skilled in the art. Alternatively, more than one sensor may be provided in the overcap in lieu of the switch assembly 264 or in combination with same. It is anticipated that one skilled in the art may provide any type of sensor either alone or in combination with the switch assembly 264 and/or other sensors to meet the needs of a user. In one particular embodiment, the switch assembly 264 and a sensor are provided in the same overcap. In such an embodiment, a user may choose to use the timer-based switch assembly 264 to automatically operate the drive unit 260 of overcap 10, or the user may choose to use the sensor to detect a given event prior to activating the overcap 10. Alternatively, the overcap 10 may operate in a timer and sensor based mode of operation concurrently.

The LED 268 illuminates the light transmissive rod 82 when the overcap 10 is in an operative state. The LED 268 blinks intermittently once every fifteen seconds during the sleep period. Depending on the selected operating mode, the blinking frequency of the LED 268 begins to increase as a spraying period becomes imminent. The more frequent illumination of the LED 268 serves as a visual indication that the overcap 10 is about to discharge fluid contents into the atmosphere.

Figure 20:
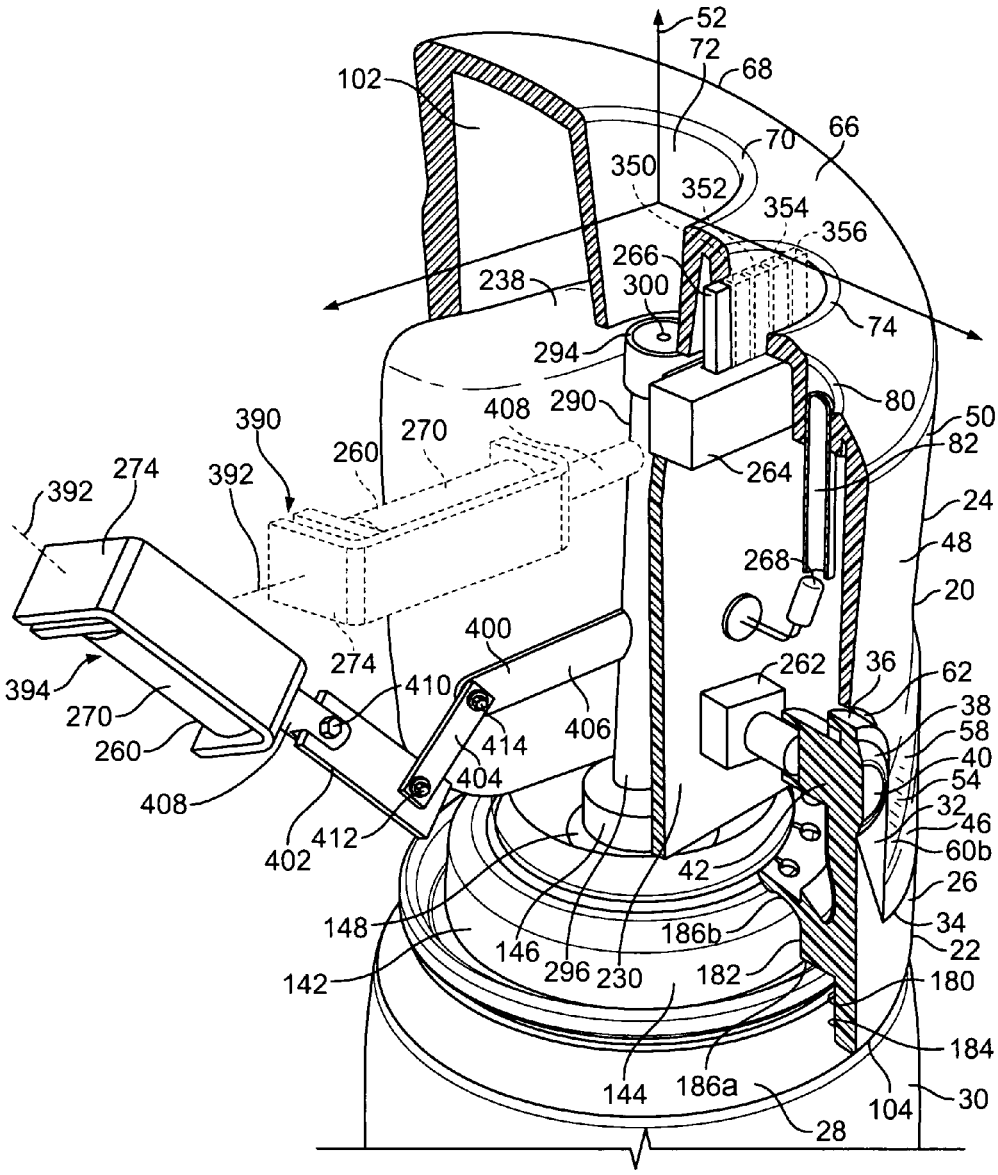
FIG. 20 illustrates different orientations that a solenoid may be positioned in within the overcap of FIGS. 1-16.

It is envisioned that the drive unit 260 can be disposed in different operable orientations without departing from the principles described herein. As shown in FIG. 20, the drive unit 260 may be disposed in a first position 390 so that a central axis 392 of the drive unit 260 is perpendicular to the longitudinal axis 52 of the container 30. In another embodiment, the axis 392 of the drive unit 260 is disposed in a second position 394 at a 45 degree angle relative to the longitudinal axis 52 of the container 30. Indeed, the drive unit 260 may be positioned in any number of orientations, wherein the axis 392 of the drive unit 260 is parallel to, perpendicular to, or at any other angle relative to the longitudinal axis 52 of the container 30. It will be apparent to those skilled in the art how the bell crank 308 and/or the connector 318 can be adjusted to remain in operable communication with the dispensing member 290 and the drive unit 260.

It is also contemplated that other linkage and mechanical systems may be used to impart rotational movement and transverse forces to the valve stem 172. For example, FIG. 20 illustrates an embodiment having the drive unit 260 disposed at a 45 degree angle relative to the longitudinal axis of the container 30. A linkage system 400 includes first, second, and third arms 402, 404, 406, respectively. The first arm 402 is attached to an armature 408 of the solenoid 270 by a pin 410. The second arm 404 is attached to the first and third arms 402, 406, by pins 412 and 414, respectively. The third arm 406 is also integrally attached to a portion of the dispensing member 290. When the solenoid 270 is activated, the linear motion of the armature 408 forces the first arm 402 to move downwardly and laterally toward the dispensing member 290. The third arm 406, which is mechanically linked to the first arm 402 by the second arm 404, is rotationally displaced about the longitudinal axis 52. The rotational displacement of the third arm 406 in the present embodiment causes the dispensing member 290 to tilt away from the solenoid 270 in a direction opposite to the embodiments disclosed above. However, similar to the previous embodiments, the rotation of the dispensing member 290 causes the bottom end 296 thereof to engage with and rotationally displace the valve stem 172. The rotational displacement of the valve stem 172 includes transverse force components that act upon the valve stem 172 to tilt same and open the valve assembly within the container 30 to discharge fluid therefrom. It is envisioned that the drive unit 260 may be angled to any degree with respect to the valve stem 172, and/or the longitudinal axis 52 of the container 30. Further, it is also envisioned that the linkage system 400 of the present embodiment may be modified to fit within any of the overcaps shown herein, e.g., by reducing the size of one or more of the arms 402-406.

FIG. 20 depicts yet another embodiment in which the drive unit 260 is disposed transverse to the longitudinal axis 52 of the container 30. During an actuation sequence, the armature 408 is directed along a path having a directional component perpendicular to the longitudinal axis 52 of the container 30 so that in an extended position the armature 408 will impact the dispensing member 290. Application of such a transverse force on the dispensing member 290 will cause same to rotate about the longitudinal axis 52 and for the valve stem 172 to be placed in an open position, thereby allowing discharge of the contents of the container 30. In a different embodiment, the dispensing member 290 is removed altogether and the armature 408 is adapted to directly impact the valve stem 172 during an actuation sequence. In another embodiment, a linkage system (not shown) is provided between a distal end of the armature 408 and a portion of the dispensing member 290.

Figure 21:
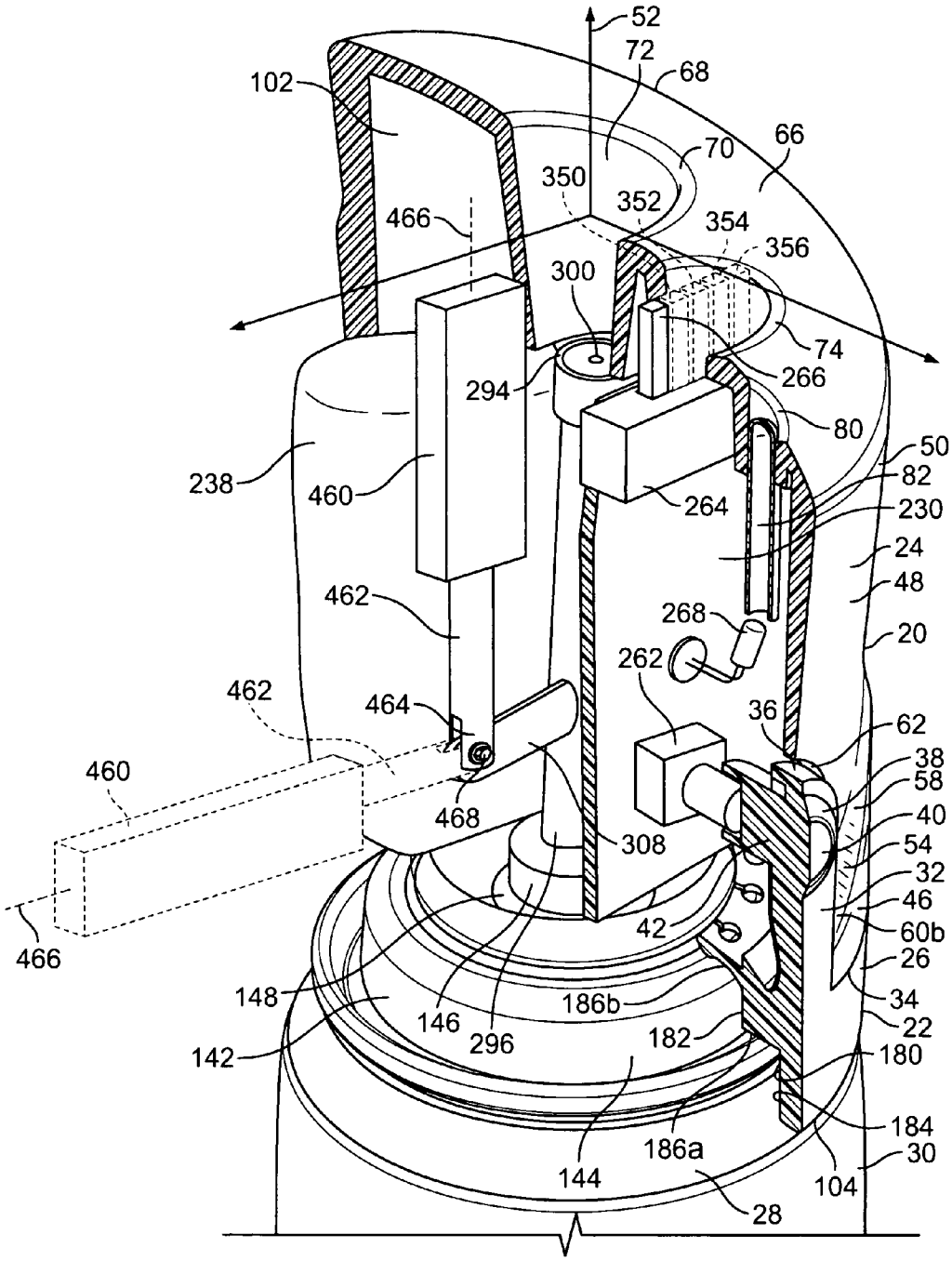
FIG. 21 illustrates another embodiment of an overcap similar to the overcap of FIG. 20 except that the solenoid has been replaced by a bimetallic actuator.

In another embodiment depicted in FIG. 21, the solenoid of the drive unit 260 is replaced with a bi-metallic actuator 460. The bi-metallic actuator 460 includes a bi-metallic element 462, which contracts and expands in a predeterminable manner when provided with heat. Conventional bi-metallic elements comprise at least two strips of metals, which exhibit different thermal expansion properties. By joining two such strips of metal together, e.g., by brazing, welding, or rivets, a bi-metallic actuator will undergo a predeterminable physical transformation upon the application of a known level of heat. The bimetallic actuator 460 may include a self contained heat source responsive to an electrical signal from a timer or a sensor. For example, the control circuitry previously described herein may be adapted to activate a heater in response to the expiration of a specified time interval. One skilled in the art will realize that many different types of heaters may be used with the embodiments described herein, e.g., an electric resistance heater, such as a metal oxide resistor, may be used with the bimetallic actuator 460.

In the present embodiment, when a known level of heat is provided to the bi-metallic actuator 460, a distal end 464 of the bimetallic element 462 bends in a direction substantially transverse to the longitudinal axis 52 of the container 30 and a longitudinal axis 466 of the actuator 460. For example, in the present embodiment the bimetallic element 462 is secured to the bell crank 308 by a pin 468. When the bimetallic element 462 bends upon the application of heat, the distal end 464 of the element 462 bends in a transverse direction toward the circuit board 230. The bending of the bi-metallic element 462 causes the rotational displacement of the bell crank 308 and the dispensing member 290 toward the control circuit 230. Rotation of the dispensing member 290 will cause the discharge of fluid from the container 30 in a similar manner as discussed above. When the supply of heat is terminated or a cooling operation is undertaken, the bimetallic element 462 curves back to a pre-actuation position similar to that shown in FIG. 21. It is intended that the bi-metallic actuator 460 be used in conjunction with any of the methodologies and structures disclosed herein. Further, the bimetallic actuator 460 may be similarly placed in any number of positions within the overcap 10, e.g., FIG. 21 depicts the bimetallic actuator 460 disposed in a manner parallel to and perpendicular to the longitudinal axis 52.

Figure 22:
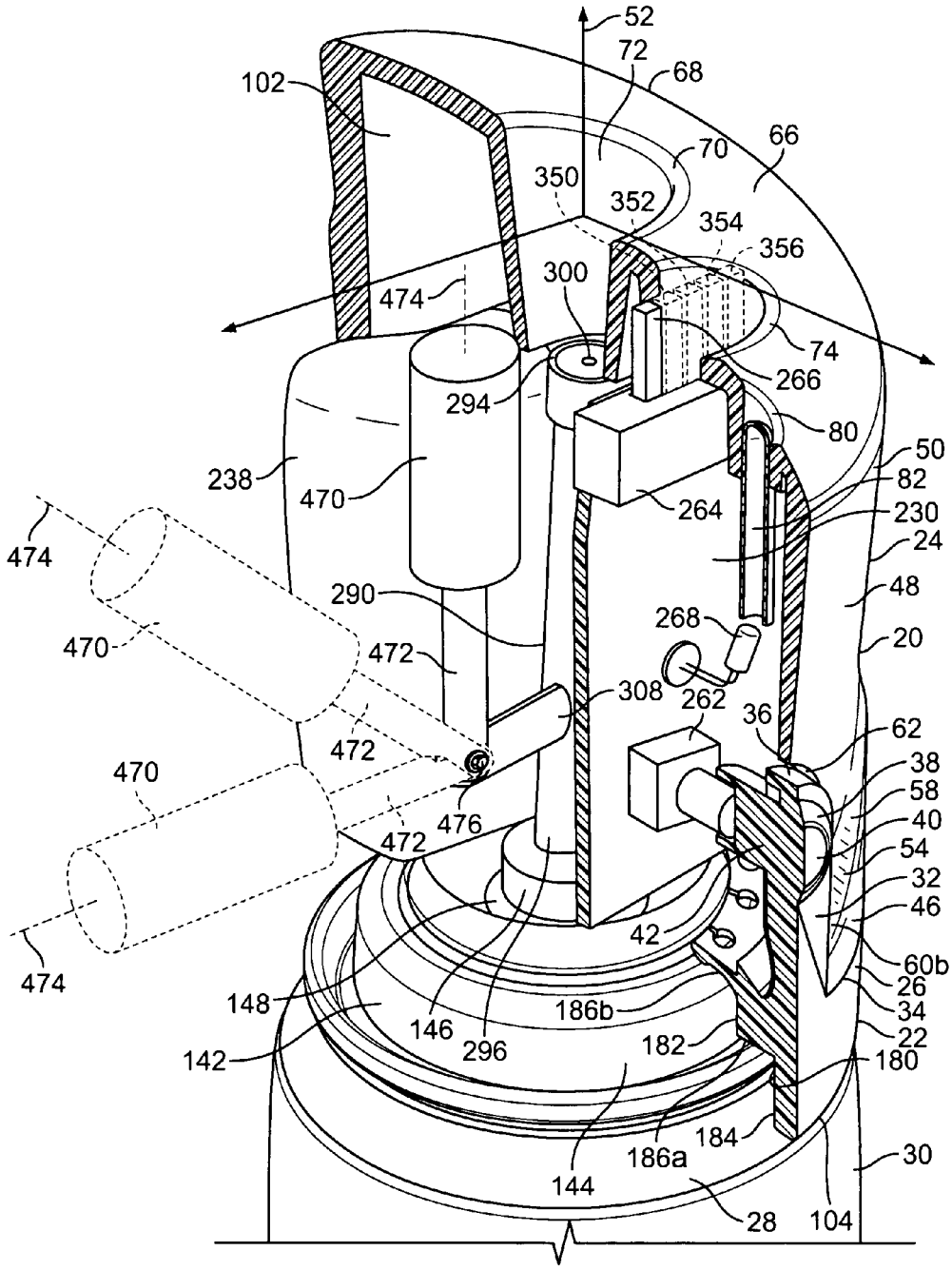
FIG. 22 illustrates still another embodiment of an overcap similar to the overcap of FIG. 20 except that the solenoid has been replaced by a piezo-linear motor.

In another embodiment illustrated in FIG. 22, the solenoid of the drive unit 260 is replaced with a piezo-linear motor 470. The piezo-linear motor 470 includes a piezoelectric element 472, which contracts and expands linearly in a predeterminable manner when provided with a specific level of electricity. Conventional piezoelectric actuators are manufactured by stacking a plurality of piezoelectric plates or disks, wherein the stack of plates or disks expands linearly in a direction parallel to an axis of the stack. The piezo-linear motor 470 of the present embodiment may comprise a motor similar to the one manufactured by Physik Instrumente GmbH & Co., of Karlruhe, Germany. It is also anticipated that other piezoelectric devices known to those skilled in the art may be used with the embodiments disclosed herein, e.g., a piezoelectric tube actuator may be used with the embodiments disclosed herein.

In the present embodiment, when a known voltage is applied to the piezoelectric element 472, same linearly expands in a direction parallel to a longitudinal axis 474 of the piezo-linear motor 470. A distal end of the piezoelectric element 472 is attached to the bell crank 308 by a pin 476. Expansion of the piezoelectric element 472 causes same to impact the bell crank 308 and cause rotational displacement of the dispensing member 290 in a similar manner as described above in connection with the other embodiments. Deenergization of the piezo-linear motor 470 allows the piezoelectric element 472 to contract and for the dispensing member 290 and the valve stem 172 to return to a non-actuation position, such as shown in FIG. 22. It is intended that the piezo-linear motor 470 be used in conjunction with any of the methodologies and structures disclosed herein. Further, the piezo-linear motor 470 may be similarly placed in any number of positions within the overcap 10, e.g., FIG. 22 shows the piezo-linear motor 470 being parallel to the longitudinal axis 52, perpendicular to the axis 52, and at a 45 degree angle relative to the axis 52.

Figure 23:
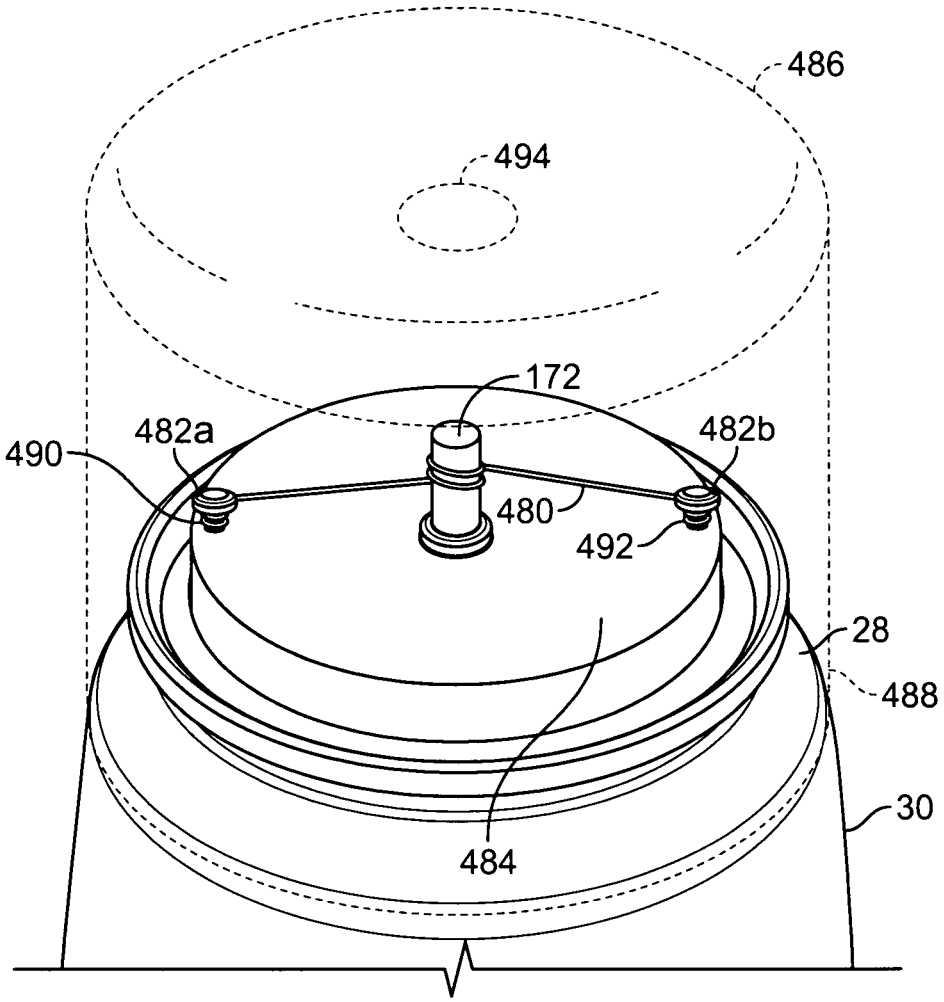
FIG. 23 is an isometric view of a different embodiment of an overcap that utilizes an electro-responsive wire.
Figure 24:
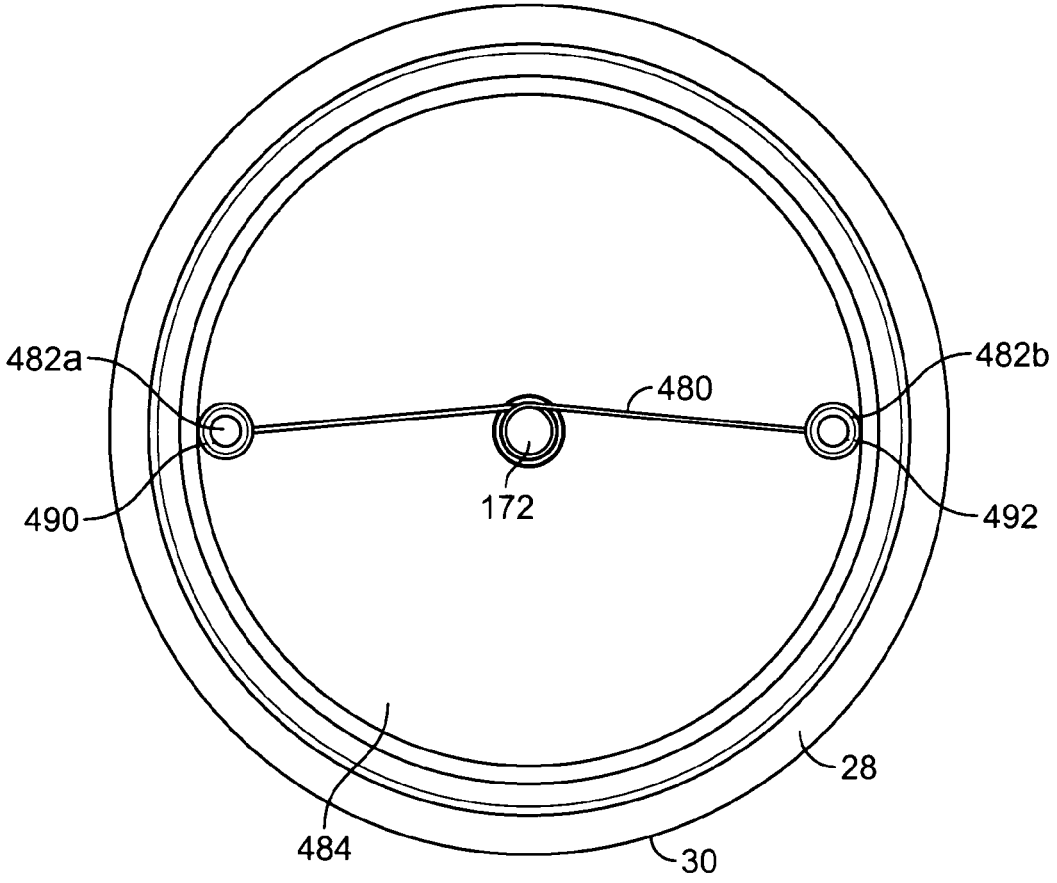
FIG. 24 is a plan view of the overcap of FIG. 23 with a portion of the overcap previously shown in dashed lines removed.
Figure 25:
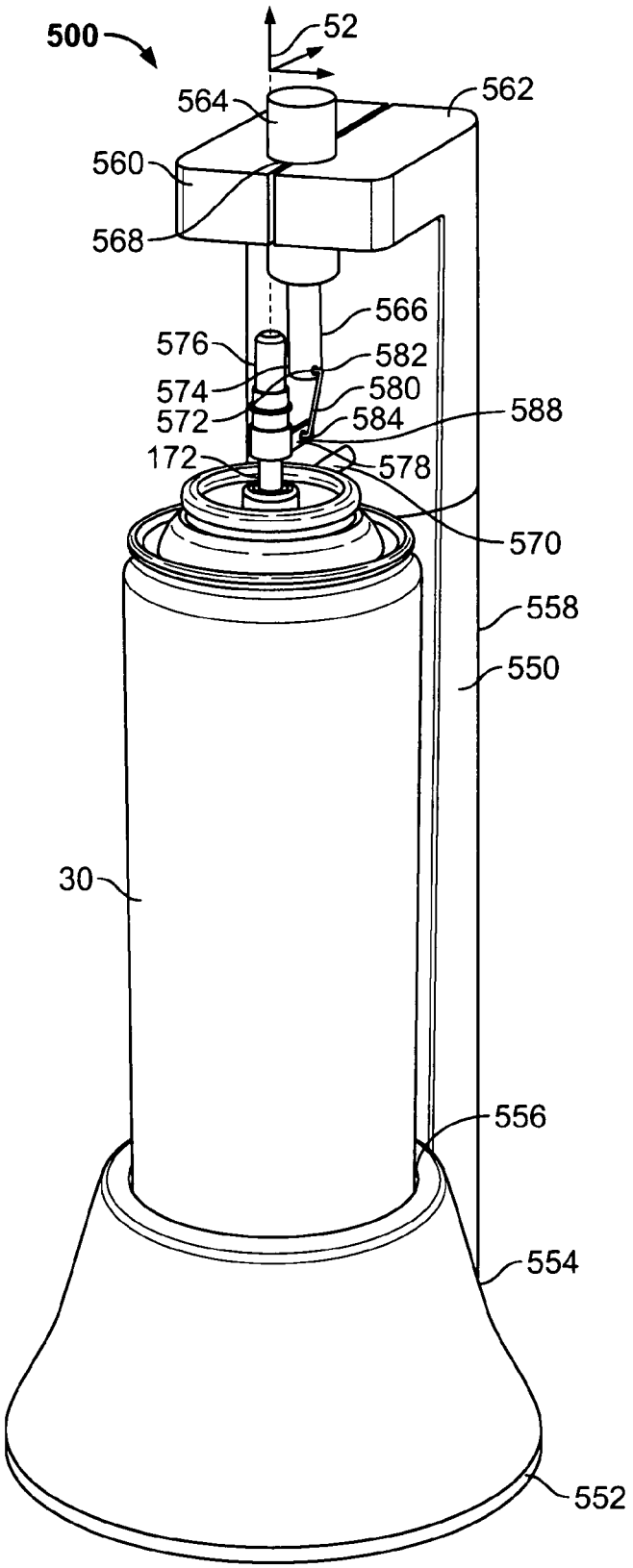
FIG. 25 is an isometric view of another embodiment of a device showing a frame, a fluid container, and a solenoid.
Figure 26:
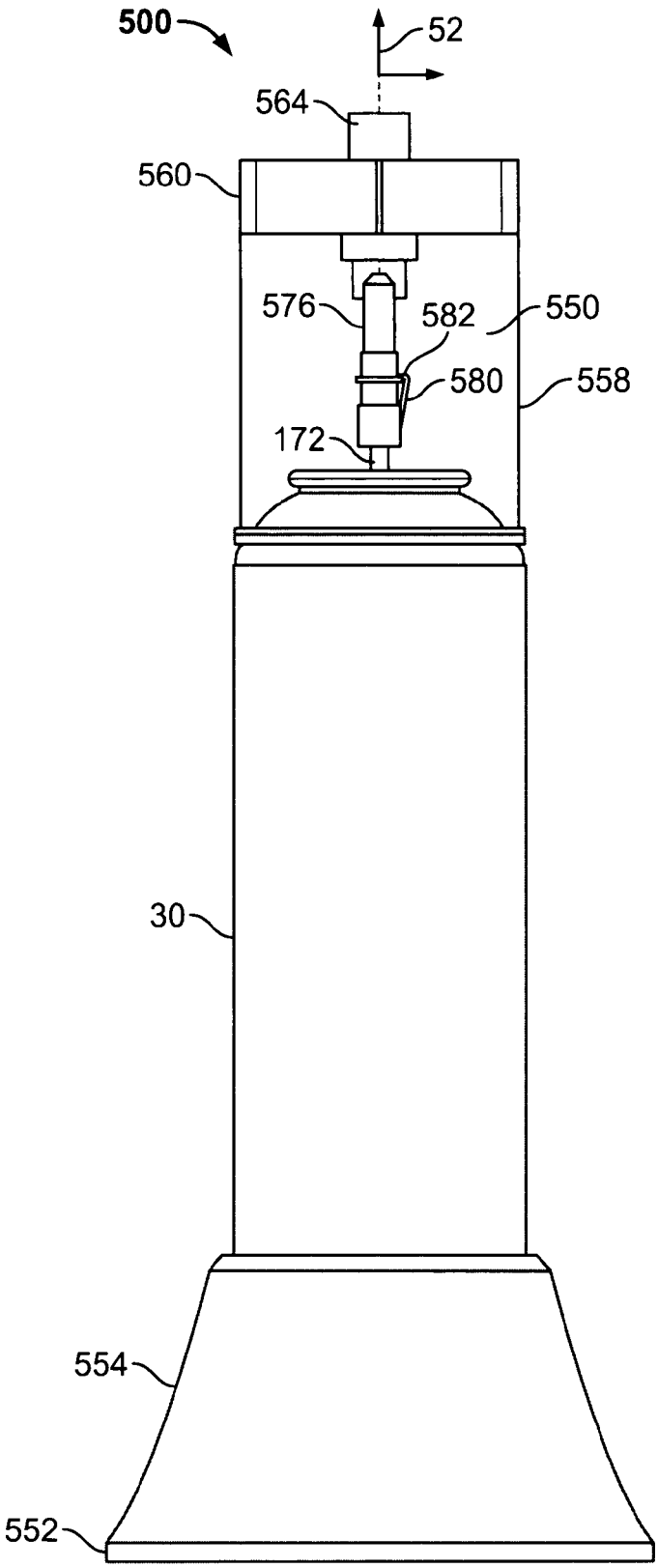
FIG. 26 is a front elevational view of the device of FIG. 25.
Figure 27:
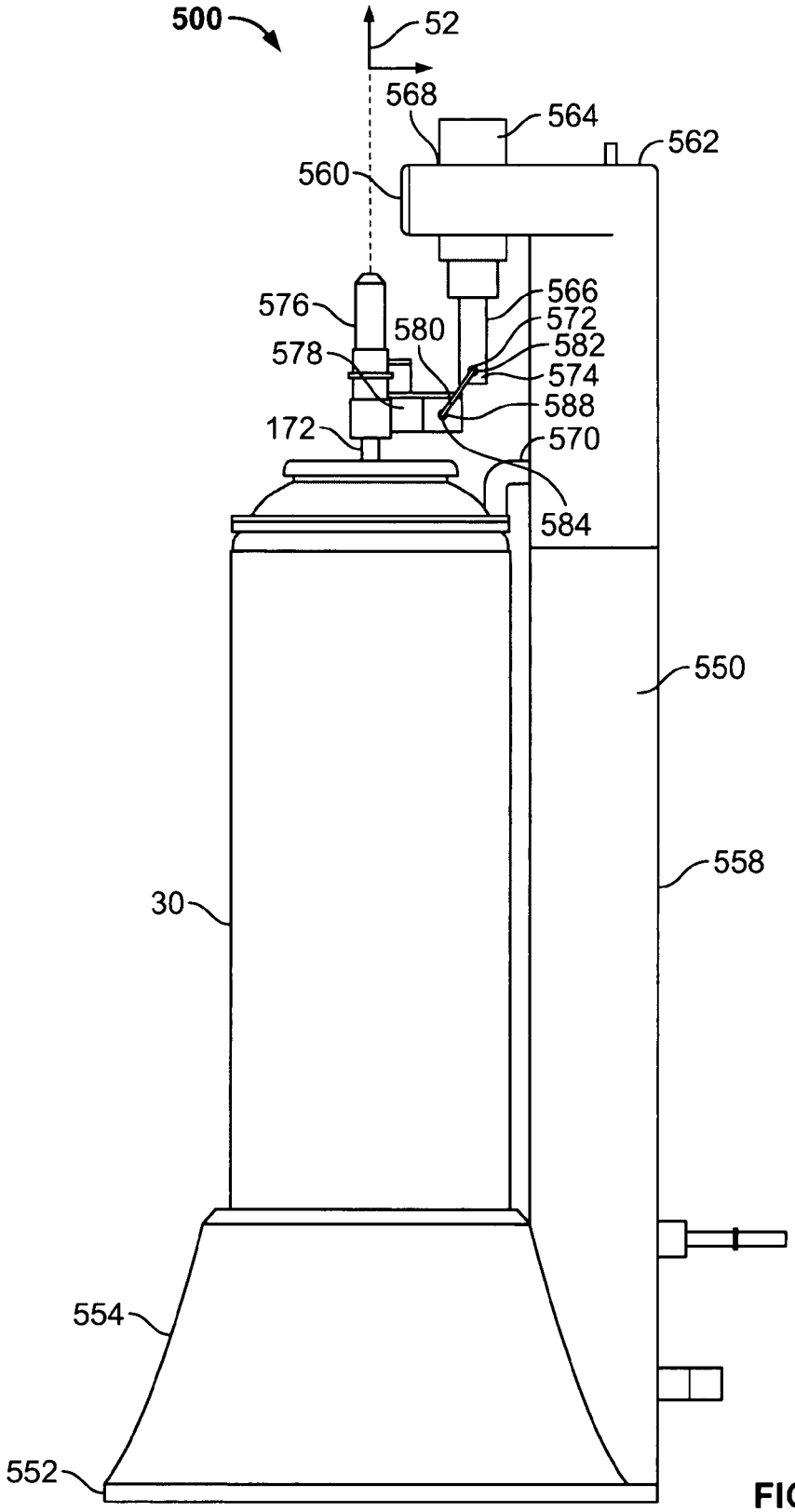
FIG. 27 is a right side elevational view of the device of FIG. 25.
Figure 28:
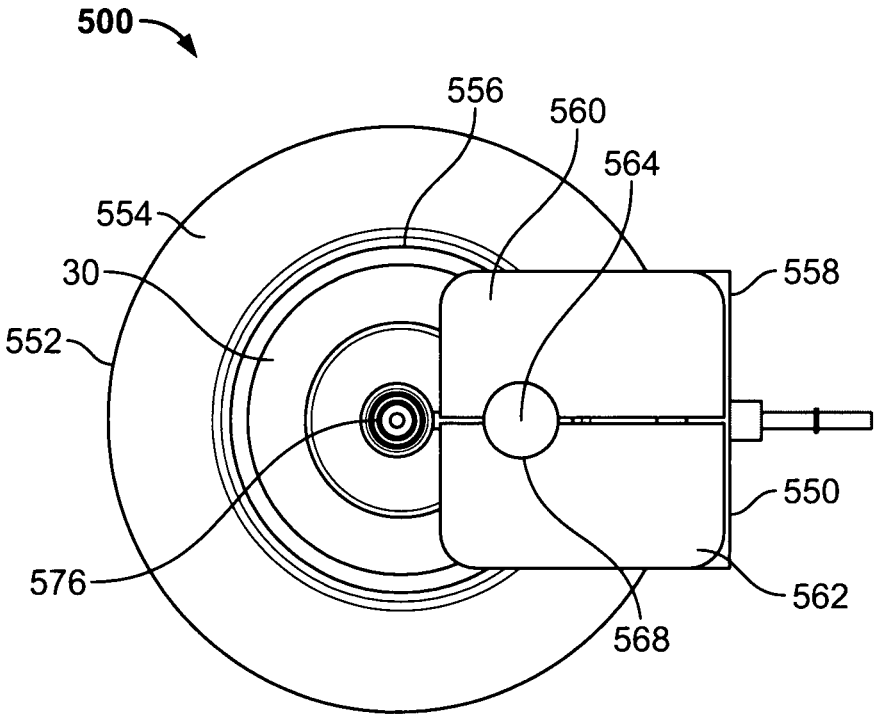
FIG. 28 is a top plan view of the device of FIG. 25.

In yet another embodiment, which is depicted in FIGS. 23 and 24, the drive unit 260 is replaced by an electro-responsive wire 480, e.g., a shape memory alloy (SMA). In the present embodiment, the SMA is a nickel-titanium alloy, which is sold under the brand name Muscle Wire® by Mondo-tronics, Inc., of San Rafael, Calif. The electro-responsive wire 480 contracts and expands in a predictable manner when supplied with a known level of heat. When the electro-responsive wire 480 is connected to an electrical power source, the resistance of the wire 480 generates the heating that is required to deform the wire 480.

In the present embodiment, wire mounts 482*a* and 482*b* are provided on an inner surface 484 of a cap 486. The cap 486 includes a bottom end 488 that is adapted to retain the cap 486 on the upper end 28 of the container 30. The electro-responsive wire 480 includes a first end 490, which is wrapped around the wire mount 482*a* and a second end 492 that is wrapped around the wire mount 482*b*. However, in other embodiments the electro-responsive wire 480 is affixed mechanically or through other means to the wire mounts 482*a*, 482*b*. In a pre-actuation position, the electro-responsive wire 480 is spaced apart from the valve stem 172 or is in contact with the valve stem 172 to a degree insufficient to open the valve assembly of the container 30. Upon receipt of an activation signal, the electro-responsive wire 480 contracts and imparts a transverse motion to the valve stem 172 sufficient to fully or partially open the valve assembly. It is anticipated that in other embodiments the wire mounts 482*a*, 482*b* may be spaced closer to or farther from the valve stem 172 on the surface 486. Further, it is also contemplated that the wire mounts 482*a*, 482*b* may be spaced closer to one another about an outer periphery of the surface 486, which in some embodiments will increase the transverse displacement of the valve stem 172. In a different embodiment, the electro-responsive wire 480 contacts a dispensing member (not shown) that is in fluid communication with the valve stem 172 instead of contacting the valve stem 172 directly, e.g., a member similar to the dispensing member 290 discussed above. Deenergerzation of the electro-responsive wire 480 causes same to expand back to a pre-actuation position, thereby allowing the valve stem 172 to return to a pre-actuation position. The contraction and expansion sequence of the electro-responsive wire 480 may be controlled by a circuit in a similar fashion to any of the operational methodologies discussed above. Further, structural components of the present embodiment such as the shape of the cap 486, the placement of a discharge orifice 494, or how the cap 486 is retained on the container 30, may be modified in light of the embodiments described herein. Likewise, it is anticipated that any of the embodiments described herein may be modified to include the inner surface 484 or any other structure disclosed herein with respect to the present embodiment.

In another embodiment depicted in FIGS. 25-28, the container 30 is placed within a device 500 having a frame 550. The frame 550 includes a base portion 552 and a tapered cylindrical wall 554. A recess 556 is provided within the base portion 552, which is adapted to receive the container 30 therein. A column 558 is integral with and extends upwardly from the base portion 552. The column 558 extends beyond a greatest longitudinal extent of the container 30. An overhang portion 560 extends perpendicularly from the column 558 at a top end 562 thereof and is suspended above a portion of the base portion 552. A solenoid 564 with an armature 566, which may be similar to the solenoid 270 described above, is mounted within an opening 568 provided in the overhang portion 560. A finger 570 extends from the column 558 and is clamped onto the neck of the container 30 to hold same substantially parallel to the column 558. The armature 566 extends downwardly toward the container 30 and is provided with a hole 572 in a distal end 574 thereof. The armature 566 is substantially parallel to the valve stem 172 extending upwardly from the container 30. A member 576, which may be similar to the dispensing member 290 discussed above, is in fluid communication with the valve stem 172 and extends upwardly toward the armature 566. The member 576 also includes an arm 578 extending substantially transversely therefrom. A rigid U-shaped wire 580 includes first and second legs 582, 584, wherein the first leg 582 is retained within the hole 572 of the armature 566 and the second leg 584 is retained within an opening 588 in the arm 578.

During an operational sequence, which may include any of the operational sequences or methodologies described herein, a control circuit (not shown) within the frame 550 generates an electrical signal in response to an elapsed timer, or sensor input, or manual actuation. The signal initiates movement of the armature 566 along a path substantially parallel to the longitudinal axis 52 of the container 30. The U-shaped wire 580, which operates in a similar manner as the connector 318 described above, causes the linear motion of the armature 566 to translate into a rotational displacement of the arm 578 and the member 576. The rotational displacement of the member 576 causes transverse forces to act upon the valve stem 172. As discussed above, the application of sufficient transverse forces to the valve stem 172 causes the valve assembly of the container 30 to open and discharge fluid into the atmosphere.

Any of the embodiments described herein may be modified to include any of the structures or methodologies disclosed in connection with different embodiments. Further, the present disclosure is not limited to aerosol containers of the type specifically shown. Still further, the overcaps of any of the embodiments disclosed herein may be modified to work with any type of aerosol container.

Industrial Applicability

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. An overcap for a dispenser, comprising:

a housing mountable on a container, wherein the container includes a tilt-activated valve stem with a discharge end, and wherein the discharge end of the valve stem is configured to be in fluid communication with a discharge orifice of the housing; and a drive unit disposed within and supported by the housing, wherein the drive unit includes a solenoid having an armature, wherein the armature is configured to move along a path substantially parallel to a longitudinal axis of the housing, and wherein movement of the armature imparts transverse motion to the valve stem to open a valve of the container for a predetermined spraying period that is determined by the selection of an automatic operation mode associated with the overcap and is followed by a predetermined period where the solenoid is de-energized, and wherein the armature, or any movable structure associated therewith, for imparting motion to the valve stem is unrestricted by the housing.

2. The overcap of claim 1, wherein the housing is mounted on the container.

3. The overcap of claim 1, wherein the housing is removably mounted to an end of the container.

4. The overcap of claim 1, wherein a longitudinal axis of the drive unit is disposed parallel to a longitudinal axis of a container.

5. The overcap of claim 1, wherein the transverse motion is imparted in response to the receipt of an electronic signal.

6. The overcap of claim 5, wherein the electronic signal is generated by a sensor.

7. The overcap of claim 5, wherein the electronic signal is generated by a timing circuit.

8. The overcap of claim 5, wherein the electronic signal is generated by the depression of a manual pushbutton.

9. An actuator for a dispenser, comprising;

a container having a tilt-activated valve stem with a discharge orifice;

a dispensing member disposed on a portion of the valve stem, wherein a conduit of the dispensing member is in fluid communication with the discharge orifice of the valve stem and with a discharge orifice of a housing; and a drive unit supported by the housing and having means for engaging the dispensing member to place the tilt-activated valve stem in an operable position for a predetermined spraying period, wherein the dispenser includes more than one automatic operating mode, and wherein a longitudinal axis of the drive unit is disposed parallel to a longitudinal axis of the container, and wherein the drive unit means for engaging the dispensing member is unrestricted by the housing.

10. The actuator of claim 9, wherein the spraying period comprises multiple sequential discharges.

11. The actuator of claim 9, wherein placement of the tilt-activated valve stem in an operable position causes a continuous dose of fluid to be discharged from the container.

12. The actuator of claim 9, wherein the dispensing member and the drive unit are disposed within a substantially cylindrical overcap attached to the container.

13. An overcap for a dispenser, comprising:

a housing configured to be mounted on a container having a tilt-activated valve stem, wherein the housing includes a discharge orifice;

a dispensing member configured to be disposed on a portion of the valve stem, wherein a conduit of the dispensing member is in fluid communication with a discharge end of the valve stem and the discharge orifice of the housing; and a drive unit disposed within and supported by the housing, wherein the drive unit includes a solenoid having an armature configured to impart transverse motion to the dispensing member for a predetermined time period followed by a predetermined sleep period where the solenoid is de-energized, and wherein the armature is configured to move along a path substantially parallel to a longitudinal axis of the housing, and wherein the armature, or any movable structure associated therewith, for imparting motion to the dispensing member is unrestricted by the housing.

14. The overcap of claim 13 further including a container having a tilt-activated valve stem.

15. The overcap of claim 14, wherein the longitudinal axis of the housing is parallel to a longitudinal axis of the container.

16. The overcap of claim 13, wherein a distal end of the armature includes a slot, and wherein a first pin extends through the slot and a first hole of a connector.

17. The overcap of claim 16, wherein the dispensing member includes a bell crank extending therefrom, and wherein a second pin extends through a hole in the bell crank and a second hole of the connector.

18. The overcap of claim 17, wherein actuation of the solenoid causes the connector to rotationally displace the bell crank, thereby causing the rotational displacement of the dispensing member.

19. A method for dispensing, comprising:

providing a housing mounted on a container having a tilt-activated valve stem with a dispensing member thereon and a drive unit disposed within and supported by the housing, wherein the drive unit includes a solenoid with an armature;

generating an electrical signal in response to one of a timer, sensor, or manual actuation;

moving the armature along a path substantially parallel to the longitudinal axis of the container to displace the dispensing member for a predetermined time, and wherein the armature, or any movable structure associated therewith, for displacing the dispensing member is unrestricted by the housing;

discharging fluid through a discharge orifice into the atmosphere external to the housing; and entering a sleep period where the solenoid is de-energized.

* * * * *